US006911181B1

(12) United States Patent
McNeil

(10) Patent No.: US 6,911,181 B1
(45) Date of Patent: Jun. 28, 2005

(54) SELF-DISPENSING STORAGE DEVICE

(75) Inventor: John McNeil, La Jolla, CA (US)

(73) Assignee: Isis Pharmaceuticals, Inc., Carlsbad, CA (US)

( * ) Notice: Subject to any disclaimer, the term of this patent is extended or adjusted under 35 U.S.C. 154(b) by 380 days.

(21) Appl. No.: 09/678,434

(22) Filed: Oct. 3, 2000

(51) Int. Cl.[7] ..... B01L 3/02

(52) U.S. Cl. ..... 422/100; 422/99; 422/102; 436/179; 436/180

(58) Field of Search ..... 436/179, 180; 221/156, 186, 200, 208, 282, 289; 422/102, 100, 101, 63–67, 99, 103; 210/198.2; 347/20

(56) References Cited

U.S. PATENT DOCUMENTS

| | | | | | |
|---|---|---|---|---|---|
| 3,650,306 | A | | 3/1972 | Lancaster | 141/238 |
| 4,461,328 | A | * | 7/1984 | Kenney | 141/67 |
| 4,498,510 | A | * | 2/1985 | Minshew et al. | 141/27 |
| 4,511,534 | A | * | 4/1985 | Bennett et al. | 422/100 |
| 4,537,231 | A | * | 8/1985 | Hasskamp | 141/238 |
| 4,621,665 | A | | 11/1986 | Webb | 141/1 |
| 4,626,509 | A | * | 12/1986 | Lyman | 435/283.1 |
| 4,985,631 | A | * | 1/1991 | Wannlund et al. | 250/361 R |
| 5,186,839 | A | * | 2/1993 | Kimura et al. | 210/656 |
| 5,516,491 | A | * | 5/1996 | Kath et al. | 422/102 |
| 5,851,491 | A | | 12/1998 | Moulton | 422/101 |
| 5,853,665 | A | | 12/1998 | Ade et al. | 422/62 |
| 5,874,971 | A | * | 2/1999 | Nishioka et al. | 347/20 |
| 5,916,524 | A | | 6/1999 | Tisone | 422/100 |
| 5,927,547 | A | | 7/1999 | Papen et al. | 222/57 |
| 5,935,859 | A | | 8/1999 | Elliott et al. | 436/54 |
| 5,976,470 | A | * | 11/1999 | Maiefski et al. | 422/103 |
| 5,988,236 | A | | 11/1999 | Fawcett | 141/130 |
| 6,033,911 | A | | 3/2000 | Schultz et al. | 436/49 |
| 6,045,757 | A | | 4/2000 | Moriarty et al. | 422/100 |
| 6,063,282 | A | * | 5/2000 | Moulton | 210/650 |
| 6,083,763 | A | * | 7/2000 | Balch | 436/518 |
| 6,165,417 | A | * | 12/2000 | Swierkowski | 422/100 |
| 6,203,759 | B1 | | 3/2001 | Pelc et al. | 422/100 |
| 6,309,891 | B1 | * | 10/2001 | Shalon et al. | 436/180 |
| 6,575,209 | B2 | * | 6/2003 | Gora | 141/238 |
| 6,620,383 | B1 | * | 9/2003 | Karg et al. | 422/100 |

FOREIGN PATENT DOCUMENTS

| | | | |
|---|---|---|---|
| WO | WO 98/04358 | * | 2/1998 |
| WO | WO 99/15876 | * | 4/1999 |

OTHER PUBLICATIONS

U.S. Appl. No. 09/411,748, filed Oct. 1, 1999, McNeil.

* cited by examiner

*Primary Examiner*—Jill Warden
*Assistant Examiner*—Dwayne K Handy
(74) *Attorney, Agent, or Firm*—Isis Pharmaceuticals Patent Department; Cozen O'Connor, P.C.

(57) ABSTRACT

A system and method for dispensing a sample using a self-dispensing system including a sample storage device, a dispensing mechanism, and a driving mechanism for driving the dispensing mechanism. The dispensing mechanism is formed as part of and is in dispensing communication with the sample storage device. Preferably the dispensing mechanism is a positive displacement type dispensing mechanism and includes an inlet valve, an actuator, and an outlet valve. The driving mechanism may be positioned internal or external to the dispensing mechanism and drives the dispensing mechanism thereby inducing a flow of a measured quantity of the sample into or out of the storage device. Preferably, the dispensing mechanism is relatively inexpensive and is disposable. The system and method may include an individual dispensing mechanism having a single storage device and a single dispensing mechanism, or alternatively, may include a plurality of storage devices each having a corresponding dispensing mechanism arranged in, for example, a plate. The self-dispensing system of the present invention is preferably implemented in an automated system having one or more robots for positioning the samples to be dispensed. The system and method provide for precision and reproducible dispensing of a sample with improved efficiency and throughput by eliminating the need for tip changes and washes between each sample transfer operation.

25 Claims, 20 Drawing Sheets

"Cow Udder" Embodiment

Self Dispensing Sample Container

Figure of "Time and Pressure" Embodiment

"Cow Udder" Embodiment

"Cow Udder" Embodiement
Passive Inlet Valve

Fig. 7A
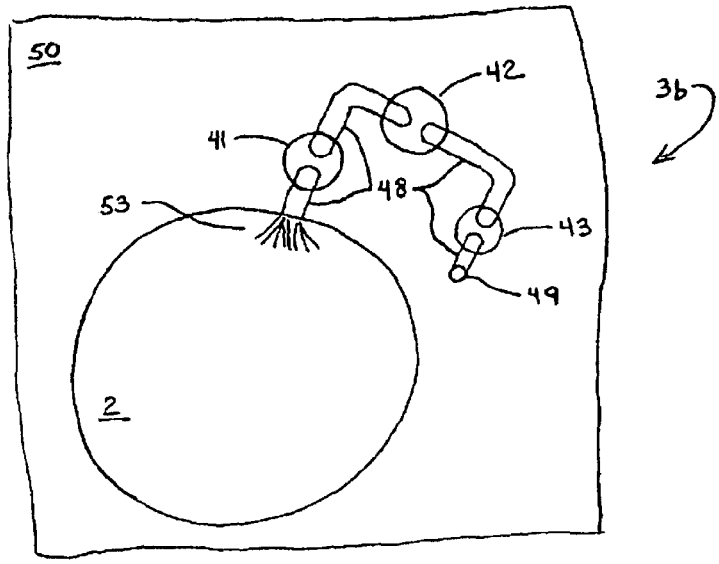
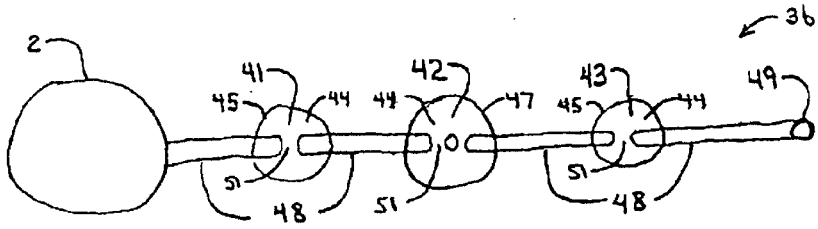
Fig. 7B
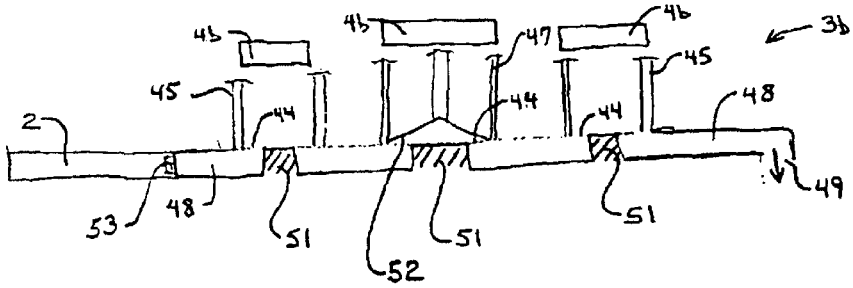
Fig. 7C

"Two-Dimensional Pump" Embodiment
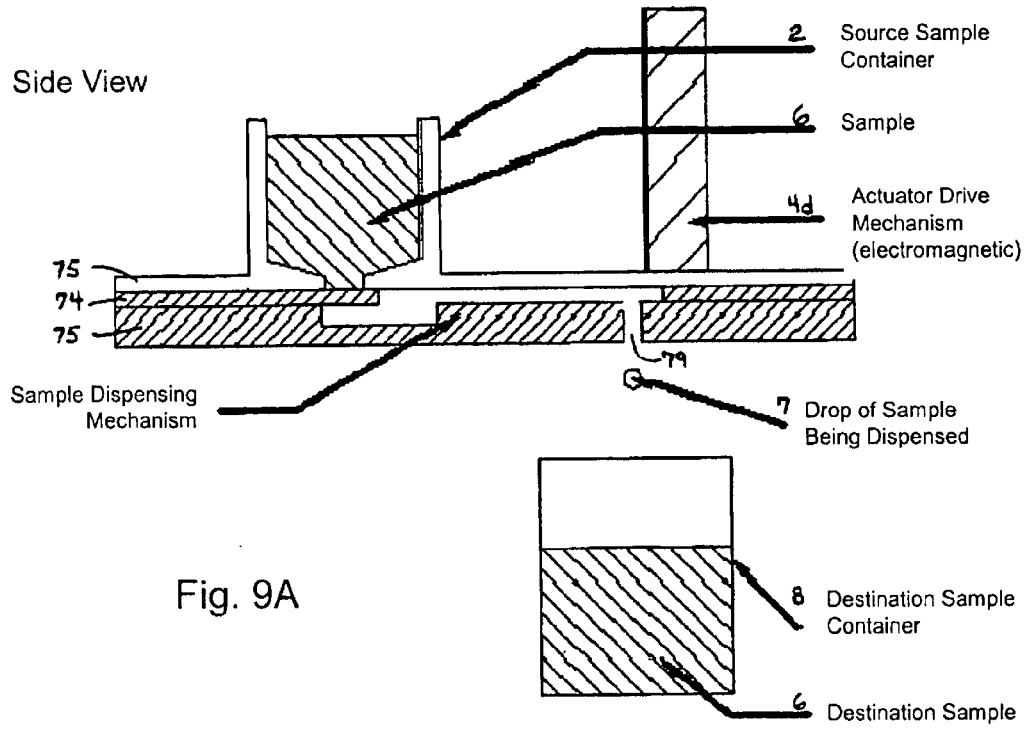
Fig. 9A
Fig. 9B
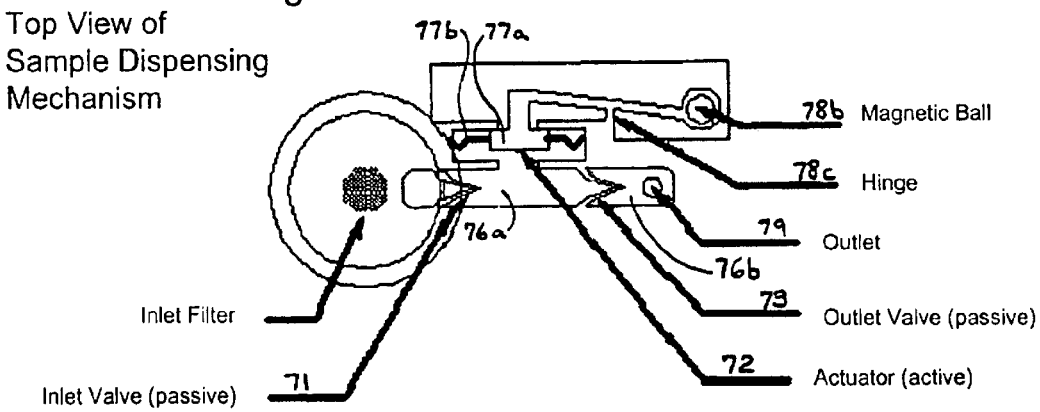

"Steam Engine" Embodiment

Top View of Sample Dispensing Mechanism

SELF-DISPENSING STORAGE DEVICE

FIELD OF THE INVENTION

The present invention relates in general to a dispensing system for dispensing a sample. More particularly, the present invention relates to a self-dispensing system including having a storage device, a dispensing mechanism, and a drive mechanism for driving the dispensing mechanism, wherein the storage device and the dispensing mechanism that form an integral unit with the dispensing mechanism in dispensing communication with the storage device.

BACKGROUND OF THE INVENTION

Various industries require automated systems for the precise dispensing of samples from one storage device to a workstation or another storage device. For example, in typical pharmaceutical research laboratory processes, labs may be involved in genetic sequencing, combinatorial chemistry, reagent distribution, high throughput screening, and the like. A dominant thread that is present in each of these processes is that, if one ignores the incubation or reaction periods (which in properly designed automation, should not tie up the other devices), the vast majority of time is spent dealing with individual sample handling (e.g., dispensing).

Individual samples refer to the samples that get distributed to a storage device, such as a well, as opposed to those samples that get distributed over, for example, multiple wells forming a whole plate. In sequencing, for example, these may include the picked bacteria and templates; in combinatorial chemistry, for example, it may include the building blocks that define the next step in the reaction, and in high throughput screening, for example, it may include the test compounds. The reason that this is such a time consuming process is that a tip wash or replacement is typically required between every transfer operation. Both washing and changing tips take a good deal of time, often as long as 15 or more seconds.

Conventional dispensing devices include, for example, pipette devices which are separate devices intended for dispensing a known quantity of a sample (e.g., biological or chemical reagents) from a source storage device to a destination storage device for use in various processes. Traditionally, these pipettes can be activated either manually or automatically. The same pipette device may draw a different sample from any number of different storage devices. Accordingly, conventional pipettes also require a tip wash or replacement between every sample transfer operation.

What is needed by various sample handling and manipulation industries, such as, for example, the pharmaceutical discovery, clinical diagnostics, and manufacturing industries, is a precise sample dispensing system and method that overcome the drawbacks in the prior art. Specifically, a system and method having a dispensing mechanism formed as part of a storage device for precisely dispensing samples from the storage device to a workstation or another storage device. What is also needed is an inexpensive dispensing mechanism that does not require a tip change or wash between each handling of a sample. Therefore, a need exists for an accurate sample dispensing system and method that overcome the drawbacks of the prior art.

SUMMARY OF THE INVENTION

The present invention is directed to a self-dispensing system and method having a dispensing mechanism contained within or formed as part of a storage device for precisely and reproducibly dispensing a measured volume of a sample. The dispensing mechanism is in dispensing communication with an opening in the storage device for dispensing a measure quantity of a sample from the storage device. Preferably, the system and method of the present invention provide a disposable dispensing mechanism that never has to be changed, washed, or cleaned. The resulting combination of the individual storage device having a dispensing mechanism is what is referred to as "a self-dispensing storage device."Since the storage device is already "contaminated" by the substance and destined for disposal it is the ideal place to put the dispensing mechanism.

In certain application having a plurality of storage devices and using automation, samples are typically stored and manipulated in, for example, 96-well microtiter plates. The resulting combination of the plurality of wells of the microtiter plate each having its own dispensing mechanism (e.g., one dispensing mechanism per well) which is in dispensing communication with an opening in the well is what is referred to as "a self-dispensing plate." The self-dispensing plate includes a plurality of individual wells or reservoirs preferably arranged at evenly spaced centers. The system and method of the present invention provide the improved efficiency and throughput due to the fact that a tip wash or replacement is not required between every sample transfer operation.

In a preferred embodiment, the dispensing mechanism can reproducibly eject drops (e.g., is reproducible in volume) having a predetermined size, such as for example, about 5 microliters, about 1 microliters, about 0.5 microliters, and about 0.1 microliters in size. The dispensing mechanism preferably ejects the drops cleanly and reproducibly and does not clog when left in the air for extended periods. The self-dispensing storage device or plate, with its sample, is preferably freezable to at least −20° C., ideally to −80° C. The self-dispensing storage device and its sample are capable of being thawed and then dispensed.

The storage device includes a reservoir defining a volume for holding a predetermined amount of a sample. The storage device is where the sample to be dispensed is stored until it is dispensed by the dispensing mechanism. The reservoir can include any suitable shape and construction, including a tube, a balloon, a well, or any other kind of reservoir or container capable of containing and holding the sample to be dispensed. The storage device may be a rigid structure or alternative, may include a collapsible structure that collapses as the sample is dispensed from it. The storage device can be made of any suitable material or may include a coating material that is compatible with the sample, including, for example, polypropylene, polystyrene, polyethylene, silicon rubber, PEEK, glass, vinyl, porcelain, metal, or the like. The sample storage device can also be made from a transparent material so that the level of the sample remaining in the sample storage device may be ascertained.

The sample includes any compound, material, reagent, serum, specimen, and the like, including but not limited to samples in liquid, powdered, pasty, viscous, or other flowable or disposable form. In an exemplary pharmaceutical research laboratory having multiple processes, the samples may include, for example: the picked bacteria and templates, in sequencing; the building blocks that define the next step in the reaction, in combinatorial chemistry; the test compounds, in high throughput screening; etc.

The dispenser or dispensing mechanism can include a time and pressure type dispensing mechanism, a positive displacement type dispensing mechanism, or any other suitable dispensing device capable of dispensing the sample in precise and repeatable measured amounts or volumes. The dispensing mechanism should be capable of reproducibly dispensing the required quantity or volume of sample from the self-dispensing storage device. The life-time of the dispenser should be at least sufficient to fire enough drops to empty the well. Since the well and dispenser are preferably disposed after use, the dispenser can be made inexpensively. Preferably, the dispenser is a positive displacement type dispensing mechanism. A positive displacement type dispensing mechanism typically includes an inlet valve, an actuator, and an outlet valve. Generally, the actuator moves in one direction to draw a quantity of the sample in from the reservoir of the storage device, and moves the other direction to push the sample out a tip opening formed in a tip of the dispensing mechanism. The outlet valve prevents air from the outside from being drawn in when the actuator makes the first, or suction, move. The inlet valve prevents the sample tom being pushed back into the storage device when the actuator makes the second, or discharge, move and dispenses the sample.

The dispenser can include a cow udder type, a membrane pump type, an embedded balls type, a two-dimensional pump type, a rotary valve type, and a steam engine type of dispensing mechanism.

The system and method include a drive mechanism for driving the dispensing mechanism. The drive mechanism can be positioned internal or external to the dispensing mechanism. Also, the driving mechanism can be operated manually or automatically. Preferably, the driving mechanism is positioned external to the dispensing mechanism and does not come into contact with the sample, and therefore the driving mechanism is not contaminated by the sample. However, the drive mechanism can also be positioned internal to the dispensing mechanism and can be replaced along with the storage device and the dispensing mechanism.

The self-dispensing system preferably includes a filter or screen disposed between the storage device and the dispensing mechanism to prevent solids from jamming or clogging the dispensing mechanism.

The storage device also preferably includes some means to prevent contamination and evaporation of the sample contained therein. The means for preventing contamination and evaporation can include a sealed storage device or a storage device having a lid. In addition, the storage device preferably includes a means of replacing the volume of the reservoir corresponding to the dispensed sample with, for example, air, so that a vacuum is not created. The means of replacing the volume of the dispensed sample can include, for example, a removable lid, a valve, or the like.

A further embodiment within the scope of the present invention is directed to a method of dispensing a sample from a storage device using a self-dispensing mechanism that is in dispensing communication with the storage device. The method includes driving the dispensing mechanism with a driving mechanism such that highly accurate and reproducibly measured volumes are dispensed.

The system and method of the present invention provide for improved processing time through the use of a self-dispensing storage device and/or a self-dispensing plate that do not require a tip change or wash between each sample handling or transfer operation. They also provide for reduced waste due to less liquid being left, unused at the bottom of the sample storage device. They also reduce wasted sample containers and time because separate dilution steps can often be avoided. Preferably, the self-dispensing storage device and/or a self-dispensing plate include a disposable storage device and dispensing mechanism.

BRIEF DESCRIPTION OF THE DRAWINGS

The foregoing and other aspects of the present invention will become apparent from the following detailed description of the invention when considered in conjunction with the accompanying drawings. For the purpose of illustrating the invention, there is shown in the drawings embodiments that are presently preferred, it being understood, however, that the invention is not limited to the specific methods and instrumentalities disclosed. In the drawings:

FIGS. 7A through 7E are schematic diagrams of exemplary membrane pump type embodiments of the dispensing mechanism of FIG. 1;

FIGS. 9A and 9B are a side view and top view of an exemplary two-dimensional pump type embodiment of the dispensing mechanism of FIG. 1;

DETAILED DESCRIPTION OF PREFERRED EMBODIMENTS

The present invention is directed to a highly accurate and repeatable self-dispensing system and method for the precise dispensing of a sample. The system for self-dispensing a sample includes a storage device and a dispensing mechanism that form an integral unit in which the dispensing mechanism is in dispensing communication with the storage device containing the sample to be dispensed. The present invention reduces or eliminates the risk of contamination of the sample or of the dispensing mechanism due to the fact that the storage device and the dispensing mechanism are formed as an integral unit. A single dispensing mechanism is used with a single storage device.

The resulting combination of the individual storage device having an individual dispensing mechanism is what is referred hereinafter as "a self-dispensing storage device". In applications having a plurality of storage devices, such as a multiple-well microtiter plate (e.g., a 96-well microtiter plate), the resulting combination of the plurality of storage devices each having its own dispensing mechanism (e.g., one dispensing mechanism per well) is what is referred hereinafter as "a self-dispensing plate". Since each storage device is already "contaminated" by the substance and is destined for disposal, it is the ideal place to put the dispensing mechanism. The system and method of the present invention provide the improved efficiency and throughput due to the fact that a tip wash or replacement is not required between every sample transfer operation. They also provide for reduced waste due to less liquid being left, unused at the bottom of the sample storage device. They also reduce wasted sample containers and time because separate dilution steps can often be avoided.

For purposes of clarity, the term "sample", as used herein, is intended to encompass any compound, material, reagent, serum, specimen, and the like, including but not limited to samples in liquid, powdered, pasty, viscous, or other flowable or disposable form. In an exemplary pharmaceutical research laboratory having multiple processes, the samples may include, for example: the picked bacteria and templates, in sequencing; the building blocks that define the next step in the reaction, in combinatorial chemistry; the test compounds, in high throughput screening; etc.

Figure 1:
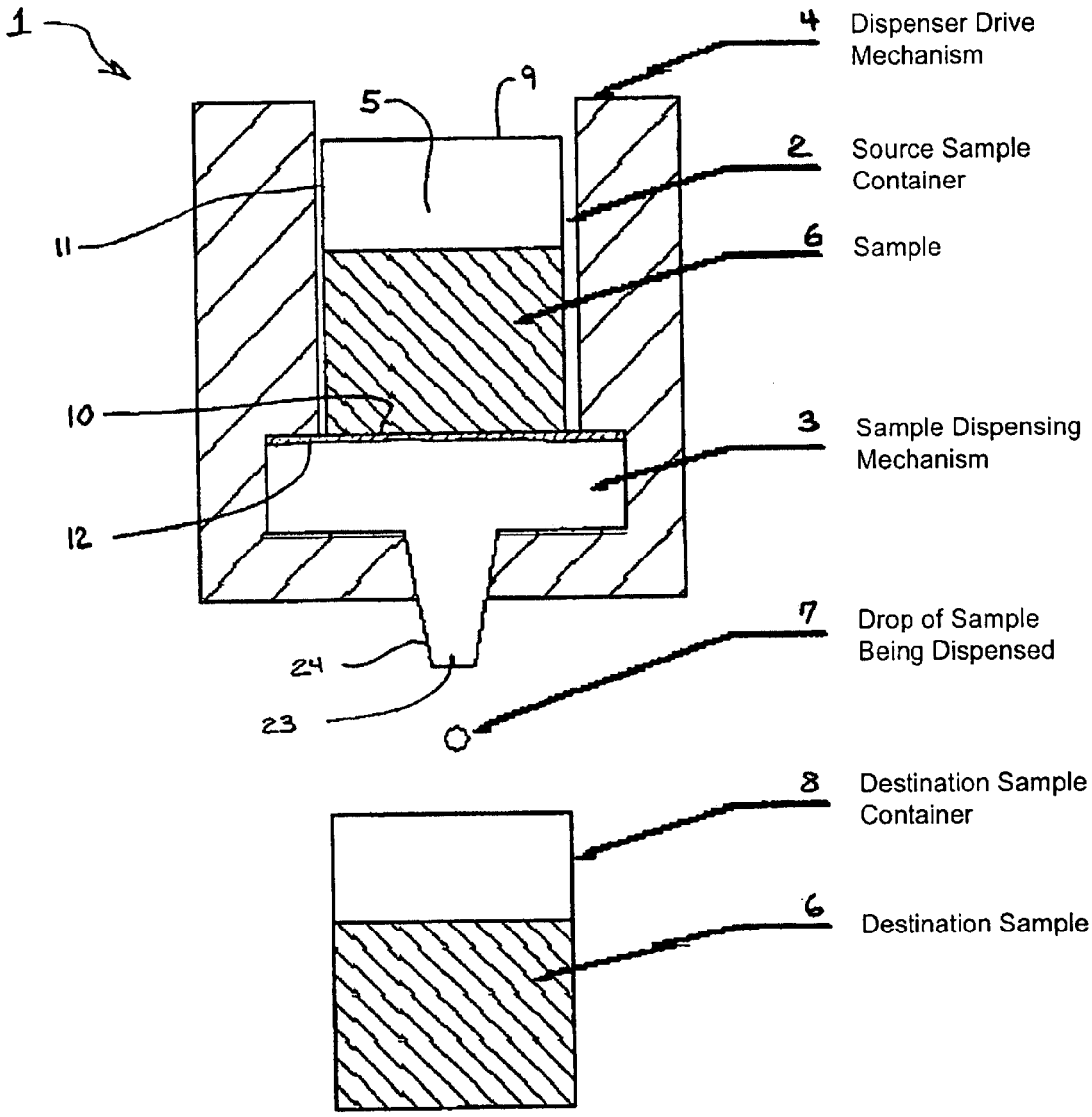
FIG. 1 is a schematic diagram of an exemplary self-dispensing system in accordance with the present invention.

FIG. 1 shows an exemplary self-dispensing system 1 in accordance with the present invention. As shown in FIG. 1, the self-dispensing system 1 includes a storage device 2, a dispensing mechanism 3, and a drive mechanism 4. The dispensing mechanism 3 is in dispensing communication with the storage device 2 making it a self-dispensing storage device. Each dispensing device 3 is used with a single storage device 2. The storage device 2 defines a volume 5 for holding a sample 6. The dispensing mechanism 3 is connected to an opening in the storage device 2 and receives the sample 6 to be dispensed from the storage device 2. The dispensing mechanism 3 is acted upon by the drive mechanism 4 to dispense a measured amount or volume of the sample 6, in the form of, for example, one or more drops 7, from the dispensing mechanism 3 to a destination workstation or another storage device 8.

Preferably, the storage device 2 and the dispensing mechanism 3 are adapted to directly contact the sample 6 being dispensed. This provides for high accuracy in dispensing. During operation, the storage device 2 and the dispensing mechanism 3 contact the sample 6 and are therefore contaminated by the sample 6. For this reason, the storage device 2 and the dispensing mechanism 3 are preferably disposable. In this case, the dispensing mechanism 3 only needs to last long enough to dispense the volume total in the storage device 2. Since the dispensing mechanism is integral with the storage device, it only comes into contact with the sample 6 that is contained therein and accordingly, no tip wash or replacement is required between each sample transfer. Once the sample 6 has been expended or used up (e.g., the storage device 2 is empty) or after some predetermined time period (e.g., at the end of the shelf life of the sample), then the dispensing mechanism 3 and the storage device 2 are disposed. This eliminates the need for a tip change or wash between each handling of the sample 6.

Preferably, the driving mechanism 4 does not contact the sample 6 and is thus insulated from contamination by the sample 6 being dispensed. The driving mechanism 4 can be internal or external to the dispensing mechanism. In embodiments having an internal drive mechanism, the internal drive mechanism would also be disposed along with the sample storage device 2 and the dispensing mechanism 3. For embodiments having an external drive mechanism, the sample 6 preferably never comes into contact with the external drive mechanism and therefore this component need not be disposable.

The self-dispensing storage device or plate can be used for dispensing stored samples in a variety of applications including, for example, pharmaceutical research laboratory processes and the like. Exemplary processes include, for example, sequencing, genetic sequencing, genotyping, functional genomics, combinatorial chemistry, reagent distribution, high throughput screening, clinical diagnostics, industrial compound testing, and the like. The self-dispensing storage device or plate can be used as part of an automated system. In this type of application, the self-dispensing system 1, including the storage device 2 and its corresponding dispensing mechanism 3, is moved about by, for example, a robot in a robotic system, to different workstations or other sample storage devices 8 where a measured quantity or volume of the sample 6 may be dispensed.

As shown in FIG. 1, the storage device 2 includes a reservoir 8 defining a volume 5 for holding a predetermine amount of a sample 6. The storage device 2 is where the sample 6 to be dispensed is stored until it is dispensed by the dispensing mechanism 3. As shown, the storage device 2 includes a top 9, a bottom 10, and at least one sidewall 11. The reservoir 8 can include any suitable shape and construction, including a tube, a balloon, a well, or any other kind of reservoir or container capable of containing and holding the sample 6 to be dispensed. The storage device 2 may be a rigid structure or alternative, may include a collapsible structure that collapses as the sample is dispensed from it. The storage device 2 can be made of any suitable material or may include a coating material that is compatible with the sample 6, including, for example, polypropylene, polystyrene, polyethylene, silicon rubber, PEEK, glass, vinyl, porcelain, metal, or the like. The sample storage device 2 can also be made from a transparent material so that the level of the sample remaining in the sample storage device 2 may be ascertained.

Figure 16:
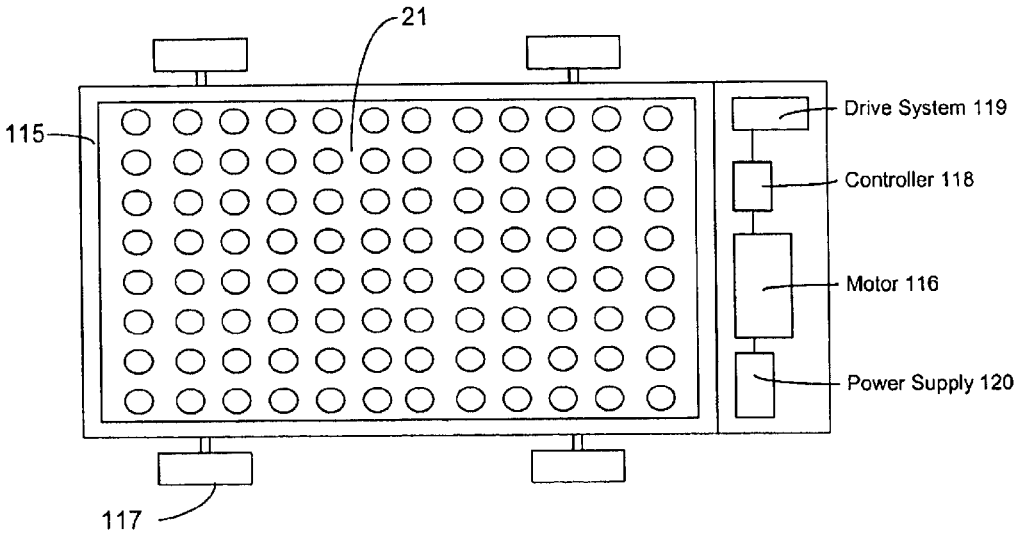
FIG. 16 is a top view of an exemplary robot carrying a self-dispensing plate of the present invention in an automated system.

The storage device 2 can include a single storage device or a plurality of storage devices. FIG. 1 shows a single storage device 2 having a dispensing mechanism 3 which is referred to as a self-dispensing storage device. The present invention also includes a self-dispensing plate which is a storage plate having a plurality of individual wells or reservoirs preferably arranged at evenly spaced centers (e.g., a 96-well microtiter plate at 9 mm centers), as shown in FIGS. 10F and 16. Each well in the self-dispensing plate has a dispensing mechanism formed integral with it and arranged in dispensing communication with it.

Preferably, the dispensing system 1 includes a filter or screen 12. The filter or screen 12 is optional and is preferred for application where the dispensing mechanism 3 draws the sample 6 from the bottom of the storage device in order to get all the sample, and also for those application where the sample to be dispensed may contain solids particles. The filter or screen 12 helps to keep the solids from jamming or clogging the dispensing mechanism 3.

The storage device 2 also preferably includes some means to prevent contamination and evaporation of the sample 6 contained therein. The means for preventing contamination and evaporation can include a sealed storage device or a storage device having a lid. In addition, the storage device 2 preferably includes a means of replacing the volume of the reservoir corresponding to the dispensed sample 6 with, for example, air, so that a vacuum is not created. The means of replacing the volume of the dispensed sample can include, for example, a removable lid, a valve, or the like.

Figure 2A:
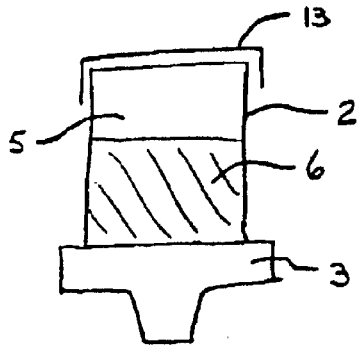
FIGS. 2A through 2F are schematic diagrams of several exemplary embodiments of the storage device of FIG. 1.
Figure 2B:
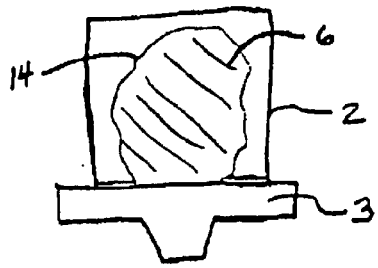
Figure 2C:
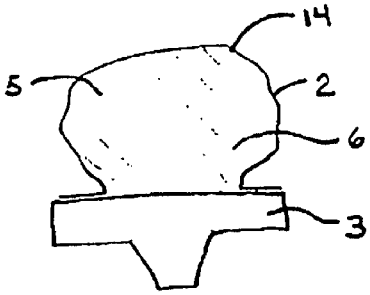
Figure 2D:
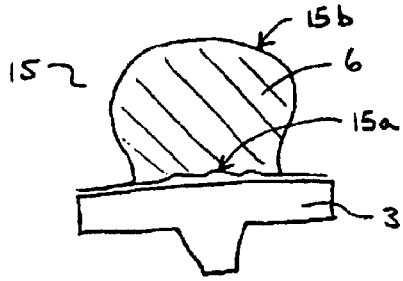
Figure 2F:
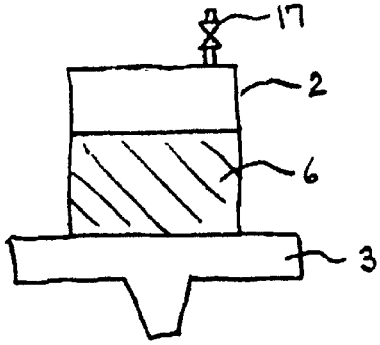
Figure 2E:
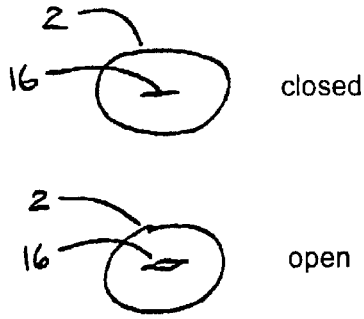

FIGS. 2A through 2F shows a variety of mechanisms that can be employed to prevent contamination and evaporation, and also allow replacement of the displaced sample 6. The mechanisms for preventing contamination and evaporation, and also allowing replacement of the displaced sample resulting from a dispensing operation can include one or more of the following features. A loose fitting lid 13 can be used that covers the storage device, while at the same time, allows air to replace the displaced volume of the dispensed sample, similar to the styrene lids currently used with microtiter plates for cell assays, as shown in FIG. 2A. Alternatively a tight fitting lid 13, like a silicon rubber "cap mat", which is removed in order to allow the sample to be dispensed can be used. Alternatively, as shown in FIGS. 2B and 2C, a non-stretching membrane 14 can be used that is expanded when full and collapsed when empty, like, for example, wine in a box, full-scale aircraft fuel tanks, or the like. The membrane 14 can be a thin flexible material, such as poly-propylene, polyethylene, or Mylar. This "blister-type" of storage device collapses as it dispenses, thus allowing no air. This design and method may be preferred because the sample is never exposed to air during storage or dispensing. Alternatively, as shown in FIG. 2D, a stretching membrane 15 such as, for example, a balloon, a pressurized fuel tank in model airplane, or the like can be used. FIG. 2D shows the stretching member 15 in a non-stretched state 15*a* wherein the reservoir of the storage device is empty, and in a stretched state 15*b* wherein the reservoir of the storage device is filled with a sample 6. This method is also preferred because the sample 6 is not exposed to air during storage or dispensing. Also, as shown in FIG. 2E, a slot 16 in the top of a rubbery or flexible storage device 2 that would be closed at rest, but leak (e.g., allow air to enter) when a vacuum is formed by a dispensing action. The top could be made from a silicon rubber material and the slot 16 would allow the displaced sample replacement member 16 to be self sealing/opening. In addition, a solid top with a one-way valve 17, such as a check valve, can be used to let air in, but not let the sample out, as shown in FIG. 2F.

Figure 3A:
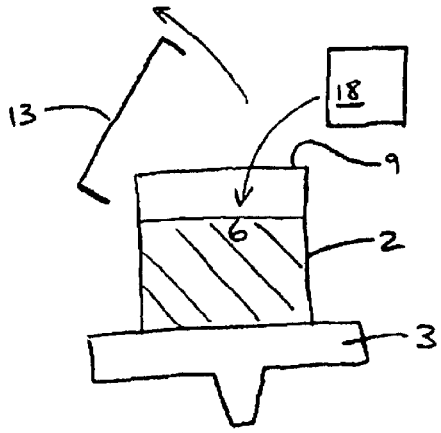
FIGS. 3A through 3C are schematic diagrams illustrating several exemplary embodiments for filling the storage device of FIG. 1.
Figure 3B:
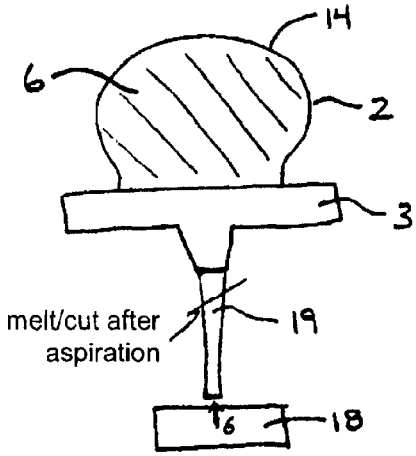
Figure 3C:
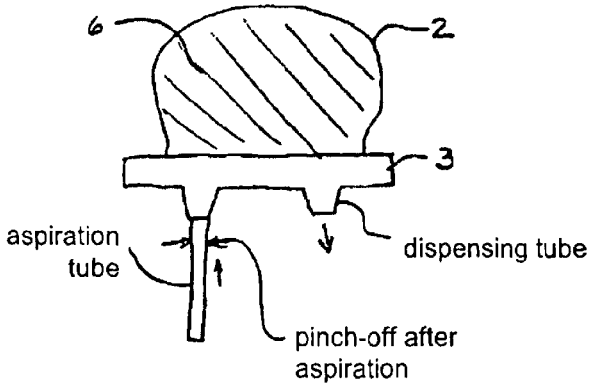

FIGS. 3A–3C show several exemplary processes that may be used to fill the storage device 2. The method used for initially filling the storage device 2 with a sample 6 to be dispensed will typically depend on the particular type of storage device that is being used and the application. For example, if removable lids 13 are employed, as shown in FIG. 3A, the storage device 2 can be filled by removing the lid 13 and adding the sample 6 from a sample supply 18 through the open top 9. The sample supply 18 can include a conventional dispensing device, such as a pipette, a self-dispensing storage device, a self-dispensing storage plate, or any other suitable sample source. Alternatively, if a stretching or non-stretching membrane type storage device 14 or 15 is used, the storage device could be filled from a temporary tube 19 extending from the bottom 10, as shown in FIG. 3B. The tube could be a conventional pipette tip attached to the bottom of the storage device or plate. The tube 19 could be dipped in the sample source 18, and a vacuum could be applied to the back of the storage device 2 to pull the sample 6 into the reservoir. A valve (not shown), such as a check valve for example, could be built into an aspiration tube, or it could be simply pinched off with a hot tool, melting it closed and removing it in one step. As shown in FIG. 3C, a separate aspiration tube 19 can be provided for filling the storage device 2 through aspiration. Once the storage device is filled, the aspiration tube 19 could be pinched-off as indicated. Once the fill or aspiration tube 19 is pinched off, it may forever remove the ability of the storage device from loading anything else. Another possible method of filling the storage device is that a disposable tip can be temporarily added in a manner that forces the valves open, or the valves can be held open by a mechanism. Alternatively, the slot 16 in the top 9 of a rubbery or flexible storage device could be pulled open or opened by pushing on the side, like, for example, a rubber coin purse. The slot 16 would seal when left alone.

Figure 4:
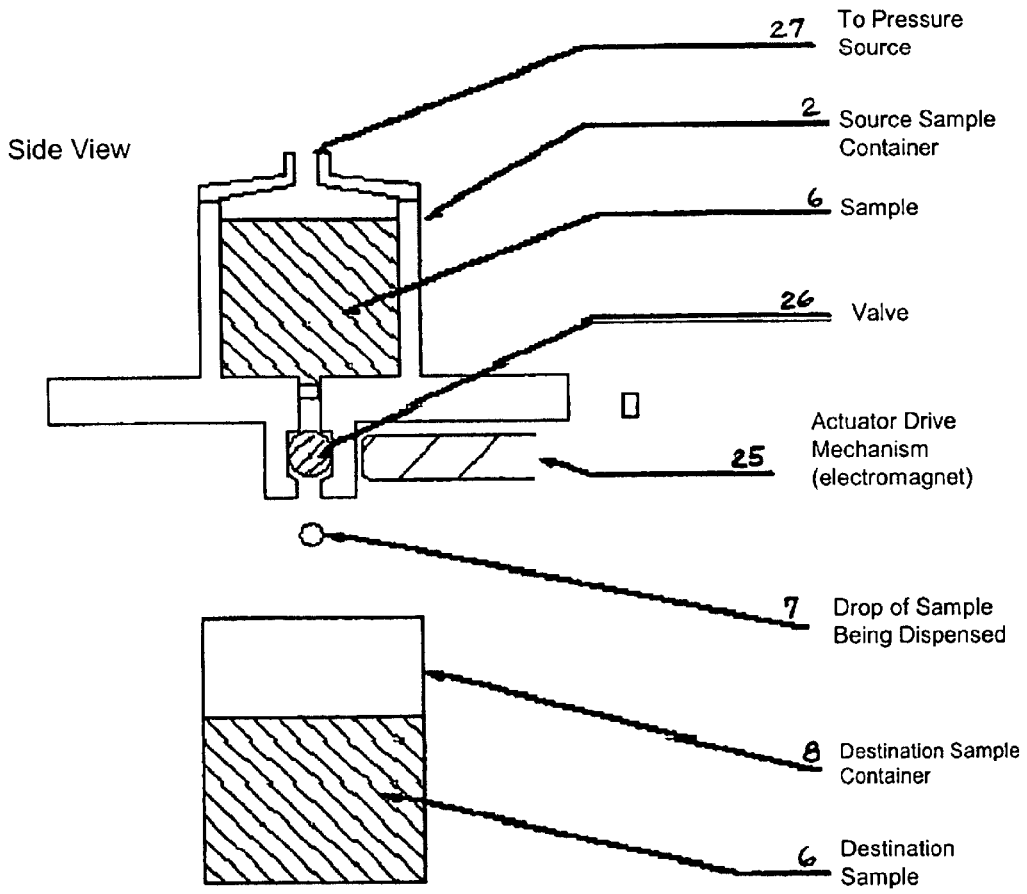
FIG. 4 is a schematic of an exemplary time and pressure type dispensing mechanism that can be used with the self-dispensing system of FIG. 1.

The dispenser or dispensing mechanism 3 can include a time and pressure type dispensing mechanism, a positive displacement type dispensing mechanism, or any other suitable dispensing device capable of dispensing the sample in precise and repeatable measured amounts or volumes. The dispensing mechanism 3 should be capable or reproducibly dispensing the required quantity of sample from the self-dispensing storage device. The life-time of the dispenser 3 should be at least sufficient to fire enough drops 7 to empty the well. Since the well 2 and dispenser 3 are preferably disposed after use, the dispenser 3 can be made inexpensively. FIG. 4 shows an exemplary time and pressure type of dispenser 3 having a valve that is closed until opened, then opened for a fixed amount of time, and a pressure upstream of the valve forces the sample through the valve. As shown in FIG. 4, an exemplary time and pressure type dispensing mechanism can include, for example, a solenoid valve 25 wherein the storage device 2 is pressurized through a pressure connection 27 from a pressure source (not shown) and a normally closed valve 26 is actuated for short, carefully measured period of time thereby dispensing a measure quantity of the sample 6. The solenoid valve 25 may be actuated using conventional techniques, including mechanically, electrically, electro-magnetically, piezo, and the like.

FIGS. 5A through 11B show several exemplary positive displacement type dispensing mechanisms 3. As shown in the Figures, a positive displacement type dispensing mechanism typically include an inlet valve 31, an actuator 32, and an outlet valve 33. Generally, the actuator 32 moves in one direction to draw a quantity of the sample 6 in from the reservoir 8 of the storage device 2, and moves the other direction to push the sample 6 out a tip opening 23 formed in a tip 24 of the dispensing mechanism 3. The outlet valve 33 prevents air from the outside from being drawn in when the actuator 32 makes the first, or suction, move. The inlet valve 31 prevents the sample 6 from being pushed back into the storage device 2 when the actuator 32 makes the second, or discharge, move and dispenses the sample 6.

The inlet valve 31 and outlet valve 33 can either be passive or active valves. An example of a passive valve is a passive check valve and an example of an active valve is an actively actuated valve. The volume of the sample to be dispensed with each stroke of the actuator is determined be the cross sectional area and stroke distance of the actuator, or the equivalent measure. Another type of positive displacement type dispensing mechanism 3 that can be used with the present invention that has a slightly different configuration is a rotating valve type of positive displacement pumps.

Positive displacement dispensing mechanisms 3 are preferred over time and pressure type valves because the samples to be dispensed may vary in viscosity and surface tension, and thus, the best way to be ensure of a precise measured volume is to dispense by volume. Preferred materials for the dispensing mechanism 3 include polypropylene, polystyrene, polyethylene, silicon rubber, PEEK, stainless steel, and the like.

Generally, samples 6 are required to be dispensed in precise and repeatable measured amounts, quantities, or volumes. For example, depending on the particular application, individual samples 6 may be dispensed from about 0.5 to about 100 microliters for typical assays and operations. Therefore, a drop dispenser that is reproducible in volume, at for example, about 5 microliters, about 1 microliters, and about 0.5 microliters, is capable of dispensing any needed amount by dispensing multiple drops 7. Alternatively, smaller measured quantities or volumes may be dispensed using dispensing mechanisms having the desired dispensing or drop rate. The drop rate can be about 0.1 $\mu$l or smaller, depending on the application. Preferably, the dispensing mechanism is capable of being accurate and reproducible within plus or minus 10 percent. Preferably, the dispensing mechanism is capable of being accurate and reproducible within plus or minus 5 percent. The drop rate or capacity of the dispensing mechanism 3 is preferably tailored to the particular application. Preferably, the drop rate and measured amount dispensed during each firing of the dispensing mechanism (e.g., the measured amount of each drop 7) are highly reproducible.

The dispensing mechanism 3 is preferably constructed such that drops 7 are ejected cleanly so that no tip touch-off is required. Small amounts of the sample 6 should not be allowed to accumulate to a large drop 7 that will fall randomly. The tip 24 may include a wiper (not shown) or the like to wipe off any excess sample from the tip 24.

Preferably, the dispensing mechanism 3 is rinsed after use, or even more preferably, it is not exposed to air after use. If the dispensing mechanism 3 is exposed to air, and evaporation is allowed to occur between uses, then any remaining solids could destroy or adversely affect the future operation of the dispensing mechanism 3.

Preferably, the entire self-dispensing system 1 is capable of being frozen and thawed one or more times. This would include the storage device, the dispensing mechanism, the sample, and, in the case of an internal driving mechanism, the driving mechanism. The dispensing system 1 should still operate reliably and accurately when thawed.

The drive or driving mechanism 4 can be disposed external or internal to the dispensing mechanism 3. The driving mechanism 4, whether it be mechanically, electrical, or electro-magnetically actuated, can be positioned external to the dispensing mechanism in, for example, a non-disposable element or machine. Preferably, the driving mechanism 4 is constructed and designed so that each sample storage device 2 and its corresponding dispensing mechanism 3 can be addressed and dispensed individually. Alternatively, some applications could have a plurality of storage devices dispensed simultaneously, such as one or more rows or columns, or all wells of a multi-well plate 21 being dispensed at once (see FIG. 10E). The external driving mechanism 4 should not come in contact with the sample 6 in order to avoid cross-contamination. Alternatively, the dispensing mechanism 4 can be positioned internal to the dispensing mechanism 3.

Figure 5A:
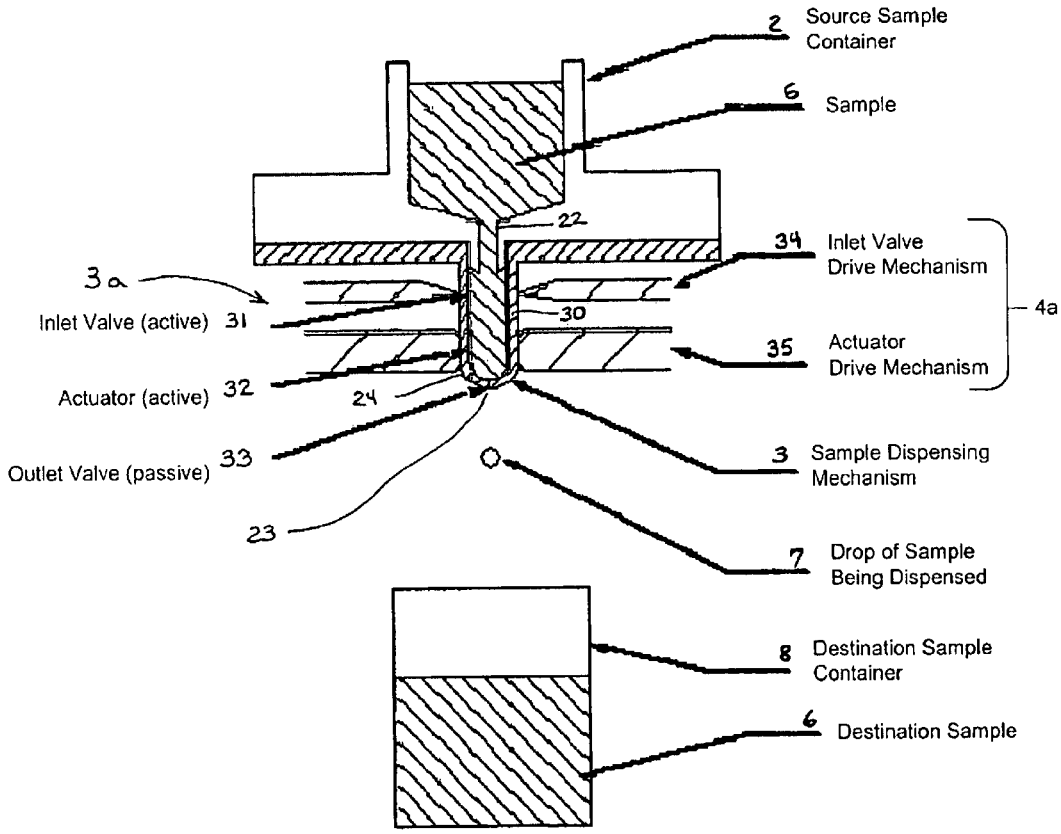
FIGS. 5A and 5B are schematic diagrams of exemplary cow udder type embodiments of the dispensing mechanism of FIG. 1.
Figure 5B:
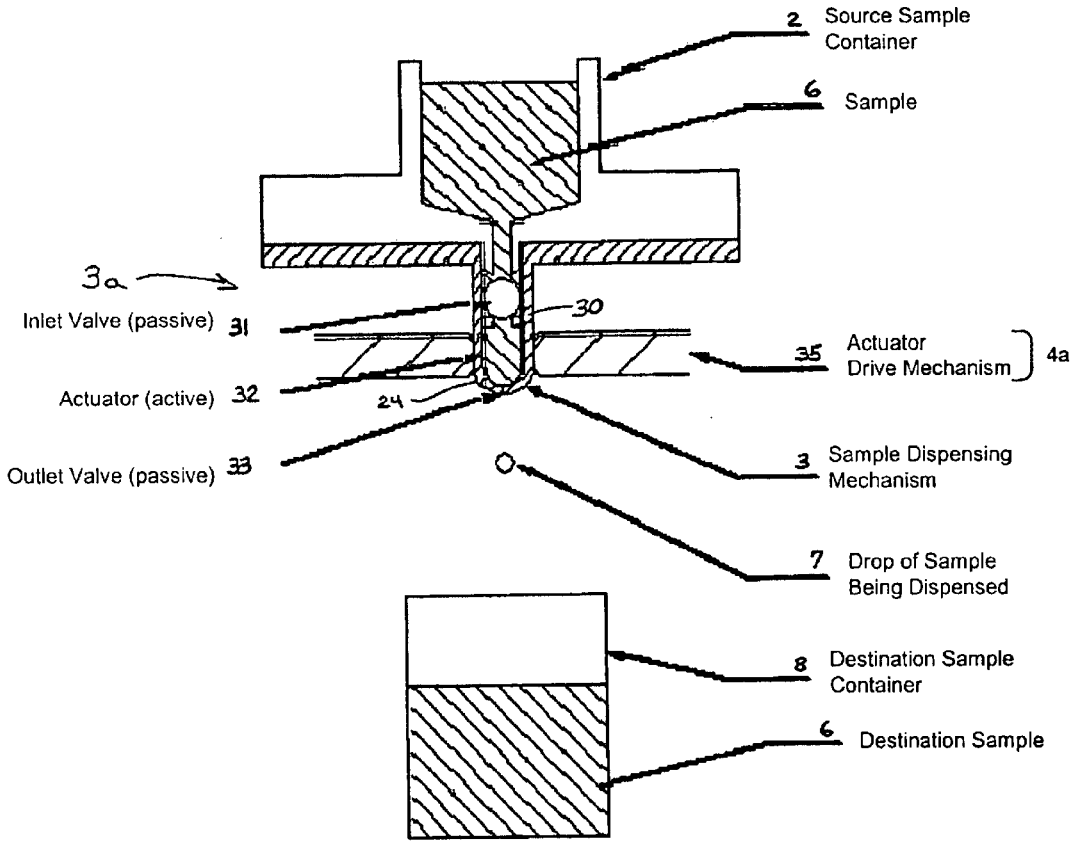

FIGS. 5A and 5B show embodiments of the dispensing system 1 having a "cow udder" type dispensing mechanism 3*a* As shown in FIGS. 5A and 5B, the cow udder type dispensing system 1 includes storage device 2 containing a sample 6 to be dispensed and a dispensing mechanism 3*a*. As shown, the dispensing mechanism 3*a* is connected to the bottom 10 of the storage device 2 and is in dispensing communication with an opening 22 formed in the storage device 2.

FIGS. 5A and 5B show the cow udder type dispensing mechanism 3*a* including a body 30 having an inlet valve 31, an actuator 32, and an outlet valve 33. In the cow udder type of dispensing mechanism 3*a*, the body 30 is preferably made of a resilient member. The inlet valve 31 and the outlet valve 33 can be active and/or passive valves. As shown in FIG. 5A, the inlet valve 31 is an active valve and the outlet valve 33 is a passive valve. The passive outlet valve 33 can be, for example, a ball valve, a resilient material with a pinhole poked in it after molding, or the like.

As shown in FIG. 5A, the self-dispensing system 1 includes a driving mechanism 4*a* having an inlet valve drive member 34 for driving the inlet valve 31 and an actuator drive member 35 for driving the actuator 32. In this embodiment, there is no outlet valve drive member because the outlet valve 33 is a passive valve.

FIG. 5B shows another cow udder type self-dispensing system 1 having both a passive inlet valve 31 and a passive outlet valve 33. Alternatively, the dispensing mechanism could be formed having an active outlet valve (not shown). Where an active outlet valve is used, the drive mechanism includes an outlet valve drive member (not shown) for driving the outlet valve 33.

In all forms of the cow udder type of dispensing mechanism 3*a*, actuation is achieved by squeezing the resilient material of body 30. When it is squeezed, the sample 6 is pushed out the outlet valve 33. When it is released, the resilient material expands and draws sample 6 in through the inlet valve 31. The dispensing mechanism operates by pinching the resilient material above and below the actuator 32. As shown, the top valve is the inlet valve 31, and the bottom valve is the outlet valve 33, and the actuator 32 is positioned between the inlet valve 31 and the outlet valve 33.

FIG. 5A shows a hybrid approach including a passive outlet valve 33 and an active inlet valve 33. Under normal operation, the normally closed outlet valve 33 opens when internal pressure is applied. To actuate this self-dispensing system 1, the active inlet valve 31 is first closed by squeezing the resilient body 30 near the top. Next the actuator 32 is squeezed. The sample 6 cannot go out the top, because of the inlet valve 31 is closed, so the sample 6 goes out the outlet valve 33 (e.g., the pinhole opening 23) in the bottom. After dispensing, the inlet valve 31 is opened while the actuator 32 remains closed, then the actuator 32 opens, drawing sample 6 in through the inlet valve 31. The inlet valve 31 can be actuated by a separate pincher 34 from the actuator driver 35, or alternatively, they can be combined.

The volume or quantity of sample 6 dispensed can be set by the resting volume of the resilient dispensing mechanism. For example, the size and shape of the resilient body 30 and the location of the inlet-valve 31, the actuator 32, and the outlet valve 33, with respect to one another, all contribute to determine the volume of sample 6 dispensed during each cycle of the dispensing mechanism 3*a*.

Advantages of the cow udder design and construction include low manufacturing cost, simple, and reliable operation. It also is difficult to plug because the actuation pressure can be very high, forcing it to unplug.

Figure 6:
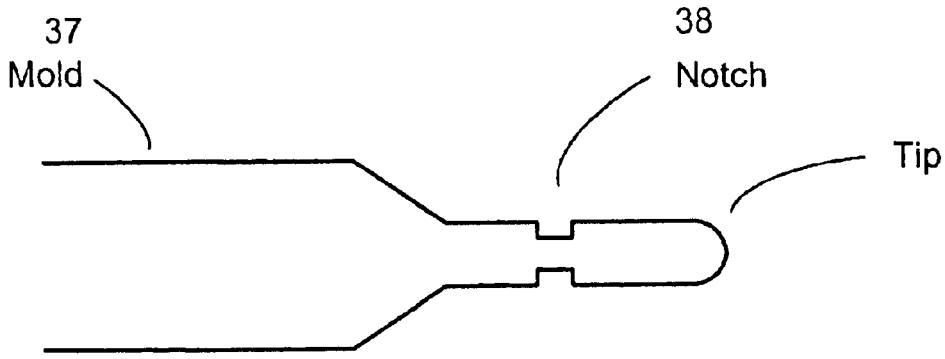
FIG. 6 is a plan view of an exemplary mold for making the cow udder type dispensing mechanism of FIGS. 5A and 5B.

FIG. 6 shows a mold 37 that can be used to form the resilient body 30. The mold 37 can have a notch 38 that makes a ridge on the molded body part. This feature can be used to reduce the actuating motion of the inlet valve 31. This can also make for a higher dispensed volume with better reproducability.

FIGS. 7A through 7E show alternative embodiments having a membrane pump type dispensing mechanism 3*b*. As shown in FIGS. 7A through 7E, the membrane pump type dispensing mechanism 3*b* includes an inlet valve 41, an actuator 42, and an outlet valve 43. As shown, the inlet valve 41 and the outlet valve 43 are active valves having a flexible membrane 44 and a valve body 45. The flexible membrane fits over the end of the cylindrical or tube shaped valve body 45. The actuator 42 includes a flexible membrane 44 and an actuator body 47. The flexible membrane 44 fits over the end of the cylindrical or tube shaped actuator body 47. Preferably, this is the same membrane as is used for the inlet and outlet valves, although it need not be. The inlet valve 41, actuator 42, and outlet valve 43 are operated using a drive mechanism 4*b*, such as a pneumatic system.

As shown in FIGS. 7A through 7E, the membrane type of dispensing mechanism 3*b* includes a plurality of tube or channels 48 for forming a dispensing communication between a storage device 2 containing a sample 6 and the dispensing exit hole 49. The channels 48 are disposed between and connecting the storage device 2 to the inlet valve 41, the inlet valve 41 to the actuator 42, the actuator 42 to the outlet valve 43, and the outlet valve 43 to an exit hole 49.

This design and construction is preferably made of a rigid lower plate 50 with a flexible membrane 44 attached over the top surface. The flexible membrane 44 may be attached to the plate 50 using conventional techniques, including gluing, heat sealing, welding (sonic, or optic), or the like. The inlet valve 41 and outlet valve 43 are made by creating the channels 48 in the lower plate through which the sample 6 to be dispensed flows. At the site of each valve 41, 43, a dam 51 is placed in the path of the channel 48, such that when the membrane 44 lays flat, the sample 6 cannot flow. In the closed position of each valve 41, 43, the tubular body 45 is placed over the membrane 44 and the membrane 44 is pressed down to form a seal with the top surface of the plate 50 and the dam 51. The valves 41, 43 are opened by evacuating the tubular body 45, thereby pulling up on the flexible membrane 44, forming an opening or bubble between the flexible membrane 44 and the dam 51. When this happens, the sample 6 can pass from the inlet channel, over the top of the dam 51, and into the outlet channel, and continues down the channels 48 toward the exit hole 49.

Figure 7D:
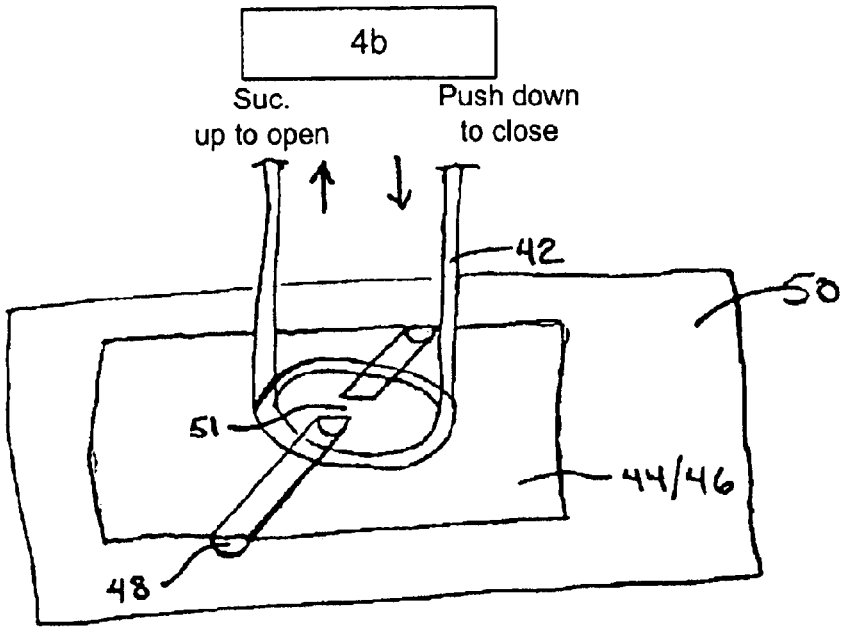
Figure 7E:
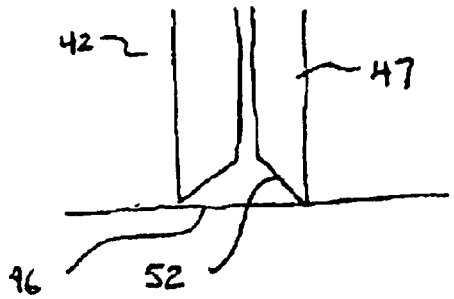

The actuator 42 has a similar construction and design, except that the actuator tube 47 preferably has a thicker side wall and is shaped to physically limit the upward travel of the membrane 44, thereby setting the positive displacement volume. As shown in FIG. 7E, the actuator body 47 includes a stop 52 that functions to limit the movement of the flexible membrane 44 and set the positive displacement volume of the dispensing mechanism. As shown, the stop 52 can be a shaped surface. The membrane type dispensing mechanism 3*b* operates in the sequence of any active valve actuator. Alternatively, instead of a single membrane being disposed over the plate, a separate membrane may be used between the inlet and outlet valve bodies 45 and the plate 50 and the actuator body 47 and the plate 50.

Advantages of a membrane type dispensing mechanism 3*b* include the fact that the same membrane 44 used to form the inlet valve 41, the actuator 42, and the outlet valve 43 can form the collapsible well 2 (e.g., wine in a box style). These can also be made very cheaply, and can have a filter 53 built in.

Figure 8:
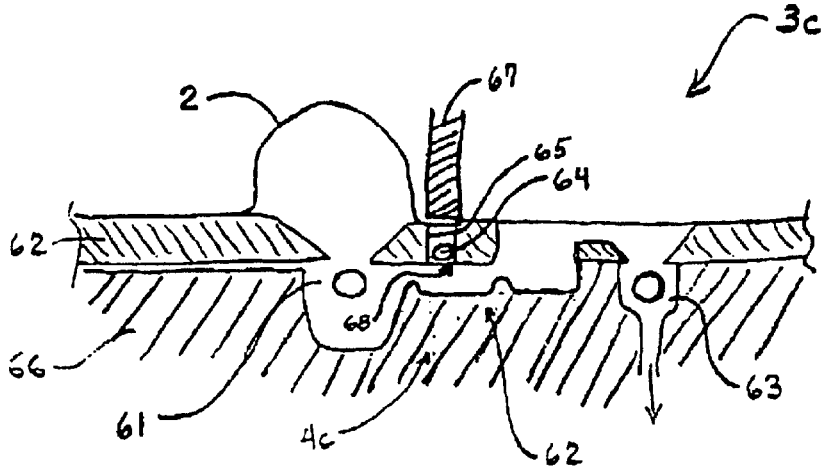
FIG. 8 is a schematic diagram of exemplary embedded balls type embodiment of the dispensing mechanism of FIG. 1.

FIG. 8 shows an alternative embodiment having an embedded balls type dispensing mechanism 3*c*. As shown in FIG. 8, the embedded balls type dispensing mechanism 3*c* includes an inlet valve 61, an actuator 62, and an outlet valve 63. The inlet and outlet valves 61, 63 can be active or passive valves. For example, the valves can be spring operated or magnetically operated. The actuator 62 preferably includes a magnetic ball 64 within a cylinder 65 (plastic or Teflon coated). The magnetic ball 64 slides in a cylindrical section 65 molded or machined into the plate 66. The drive mechanism 4*c* includes a magnetic system 67 that moves the ball 64 by applying an externally applied magnetic field. When the ball 64 moves, it displaces the sample 6 to be moved. Preferably, a sliding seal 68 is formed ball 64 and the cylinder 65 in which the ball 64 sides. Active valves may be made and operate in the same way. The back side of the actuator cylinder 65 may be connected by a passage to the storage device to prevent any sample 6 that leaks past the seal 68 from escaping the device.

FIGS. 9A and 9B show an alternative embodiment having a two-dimensional type dispensing mechanism 3*d*. FIG. 9A shows a side view and FIG. 9B shows a top view of the tow-dimensional pump type embodiment for the dispensing mechanism 3*d*. As shown in FIGS. 9A and 9B, the two-dimensional type dispensing mechanism 3*d* includes an inlet valve 71, an actuator 72, and an outlet valve 73. As shown, a center plate 74 is sandwiched between two flat surfaces 75. The center plate 74 is preferably a springy material, such as, for example, stainless steel, peek plastics, or the like and the two flat surfaces 75 can be made of, for example, Teflon or the like. Holes or cavities in the top and/or bottom plates 75 form inlet and outlet channels 76*a*, 76*b*. One of the two flat surfaces 75 has a exit hole 79. The center plate 74 has the channels, valves, and actuator. These features are preferably created by photo-etching, laser cutting, water or conventional milling, molding, or the like. The inlet and outlet valves 71, 73 can be passive or active. A check valve shape can be formed, and then slit open in a second operation so that it springs closed. The device components are preferably made flat enough so that the sample 6 is forced to pass through the valve, not over or under the features.

Preferably, the actuator 72 is made by building a piston 77*a* on a bellows 77*b*. The bellows 77*b* keeps fluids from going around the piston 77*a* without requiring a sliding seal on the sides (e.g., one on top and one on bottom). One way to actuate the actuator 72 is to create a lever arm 78*a* pivotable about a hinge 78*c* with an imbedded magnetic component 78*b* that can be moved from side to side by application of an external field.

One advantage of the two-dimensional pump embodiment is that components can be made extremely small using photolithography and etching techniques. It can also be made multilayer and combined with other micro-fluidics. Filters (not shown) can also be incorporated.

Figure 10A:
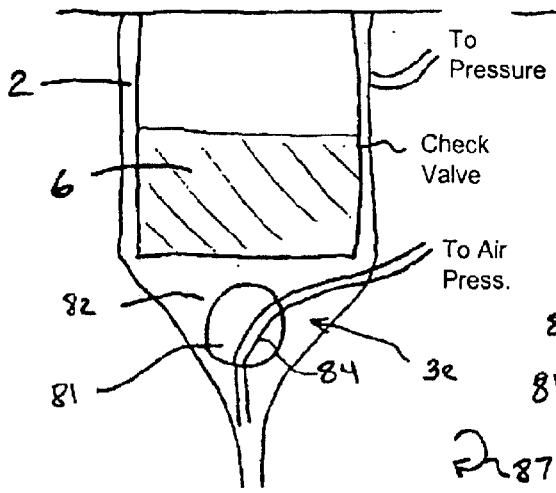
FIGS. 10A through 10F are schematic diagrams of exemplary rotary valve embodiments of the dispensing mechanism of FIG. 1.
Figure 10B:
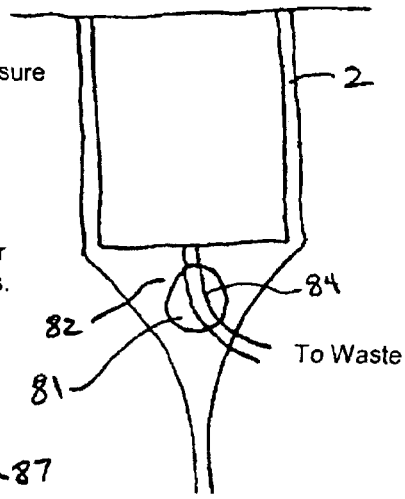
Figure 10C:
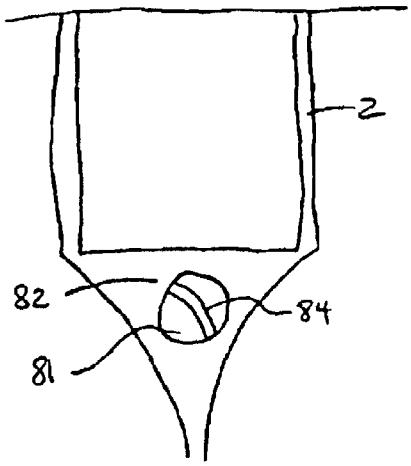

FIGS. 10A through 10E show alternative embodiments having a rotating valve type dispensing mechanism 3*e*. As shown in FIG. 10A through 10E, the rotating valve type dispensing mechanism 3*e* includes a rotating rod 81 is placed between the inlet channel and outlet channel. The rod 81 rotates in a cylinder 82 with a very close fit to prevent leaking out the sides. In one embodiment shown in FIGS. 10A through 10C, the cylinder has a hole 84 drilled through it. In one position shown in FIG. 10B it connects the inlet to a waste channel. In this position a small pulse of pressure is placed on the storage device 2 to force the sample 6 through the hole 84 in the rod 81. Next, the rod 81 rotates to its second position as shown in FIG. 10A, which connects the outlet channel to an air pressure source. This air pressure forces the small, measured, quantity or volume of sample 6 contained in the hole 84 in the rod 81 out the outlet channel. The rod 81 continues to rotate, repeating the process.

Figure 10D:
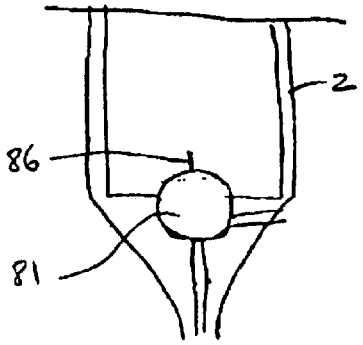
Figure 10E:
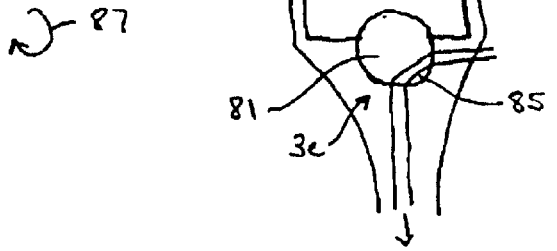
Figure 10F:
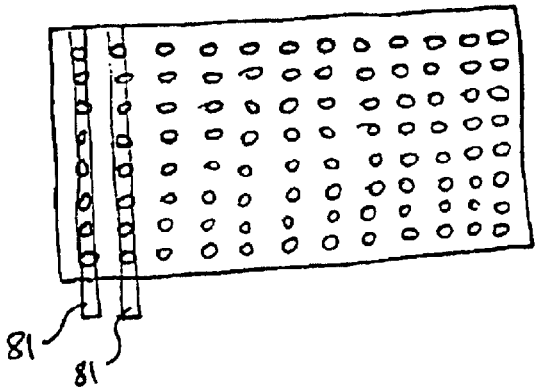

In another type of the rotating valve embodiment shown in FIGS. 10D and 10E, the rod 81 has a small slot 85 milled on its side. The slot 85 gets filled with sample when exposed to the inlet. An optional wiper 86 may be used to dislodge any air bubble (not shown)that may be left after the dispense. As the rod 81 rotates, the slot 85 comes to a position where it connects a channel with pressurized air to the outlet channel, as shown in FIG. 10E. When this occurs, the pressurized air forces the small quantity of sample 6 out of the slot 85 and out the outlet channel. The rod 81 continues to rotate in the direction of arrow 87, and the process continues. An advantage of this method is that the dispensed sample 6 volume is replaced by the same quantity of air each time, eliminating the need for any check valves in the storage device lid, or lid removal. Another advantage is that it can be operated relatively quickly by continuously rotating the rod 81. In both cases, the volume dispensed is set by the size of the hole 84 or slot 85 in the rod 81.

FIG. 10F shows a 96-well plate having a valve rod 81 connecting the wells in each column (or row). The rod 81 can be driven externally and the self-dispensing system 1 can be set up to dispense one or more of the columns at a time, or all of the wells in the plate at the same time.

Figure 11A:
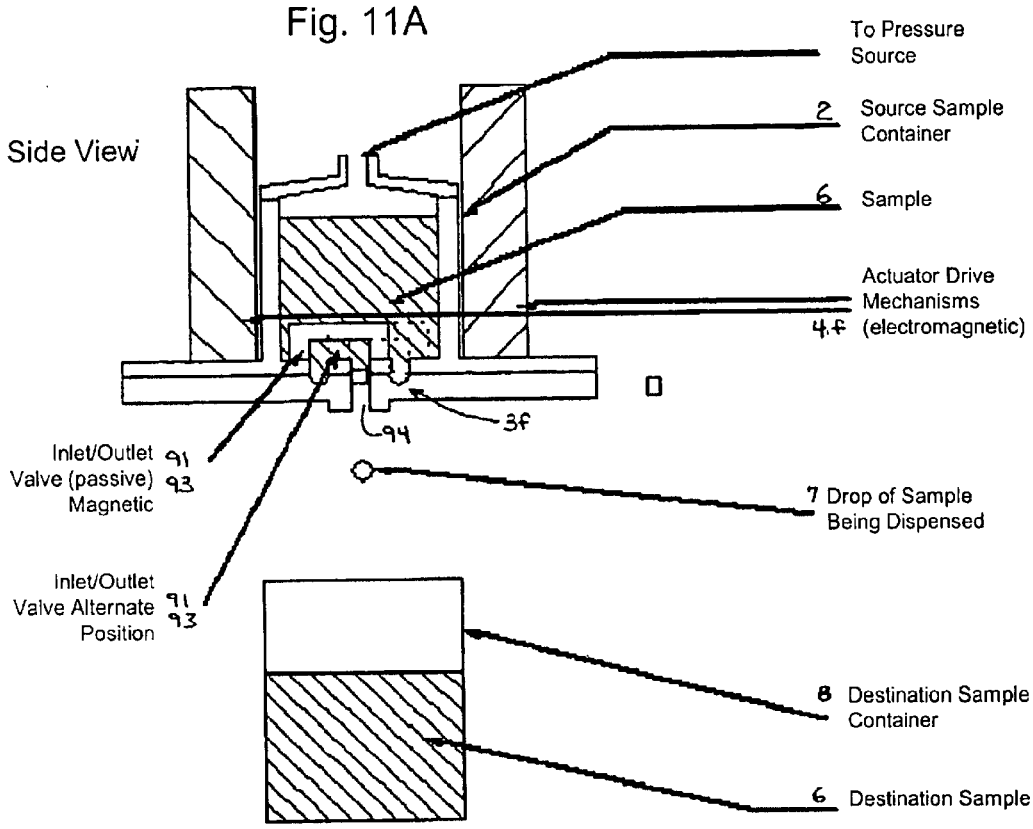
FIGS. 11A and 11B are schematic diagrams of exemplary steam engine type embodiments of the dispensing mechanism of FIG. 1.
Figure 11B:
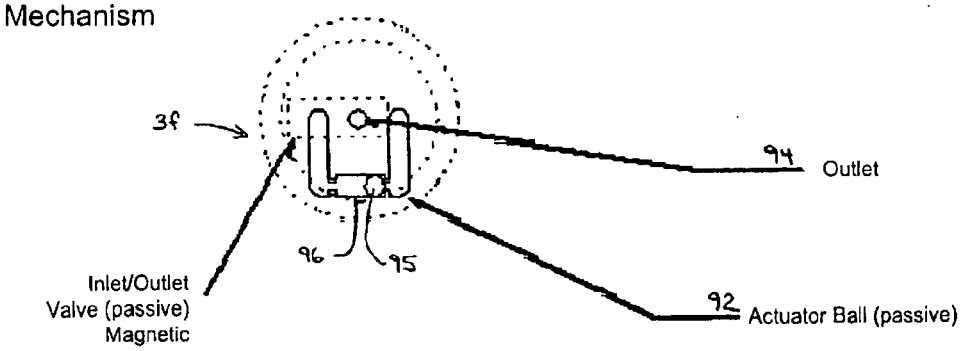

FIGS. 11A and 11B show an alternative embodiment having a steam engine type dispensing mechanism 3*f*. Generally, a steam engine type dispensing mechanism 3*f* works by having a cylinder pushed alternately on one side, then the other by expanding steam. The steam is switched from side to side by a valve that alternately switches the inlet and outlet pipes. Typical steam engines use either D valves or piston valves that swap channels as they move from side to side, covering and uncovering ports. If the steam were replaced by pressurized water, a measured quantity of water would be dispensed with each stroke.

As shown in FIGS. 11A and 11B, the steam engine type dispensing mechanism 3*f* includes an inlet and outlet valve 91, 93, an actuator 92, and an outlet opening 94. The steam engine type self-dispensing storage device could be created with the both the two-dimensional and ball pump mechanisms described herein above. The main piston 91 could be a ball 95 sliding in a cylinder 96 (as shown), a bellows mounted piston sandwiched between to flat plates, a hinged bar sweeping out an arc, etc. Similarly, both a reciprocating and a wankel rotary style four-stroke internal combustion engine could be used.

In addition, these processes that typically require precision and reproducible dispensing also typically require automated systems for the general movement of one or more samples between workstations and other storage devices where the precision dispensing of the sample at each workstation or storage device takes place. For example, for pharmaceutical research and clinical diagnostics, there are several basic types of automation systems used. Each of these conventional approaches is essentially a variant on a method to move samples from one container or storage device to another, and may perform other operations on theses samples, such as optical measurements, washing, incubation, and filtration. Some of the most common automated liquid handling systems include systems such as those manufactured by Beckman, Tecan, and Hamilton.

These conventional automation systems share the characteristic that sample transfer and manipulation operations are carried out by workstations, or devices, of some kind. These workstations can be used separately for manual use, or alternatively, can be joined together in automated systems so the automation provider can avoid having to implement all possible workstation functions. Another shared characteristic is that samples are often manipulated on standardized "microtiter plates." These plates come in a variety of formats, but typically contain 96 "wells" in an 8 by 12 grid on 9 mm centers. Plates at even multiples or fractions of densities are also used.

Figure 12:
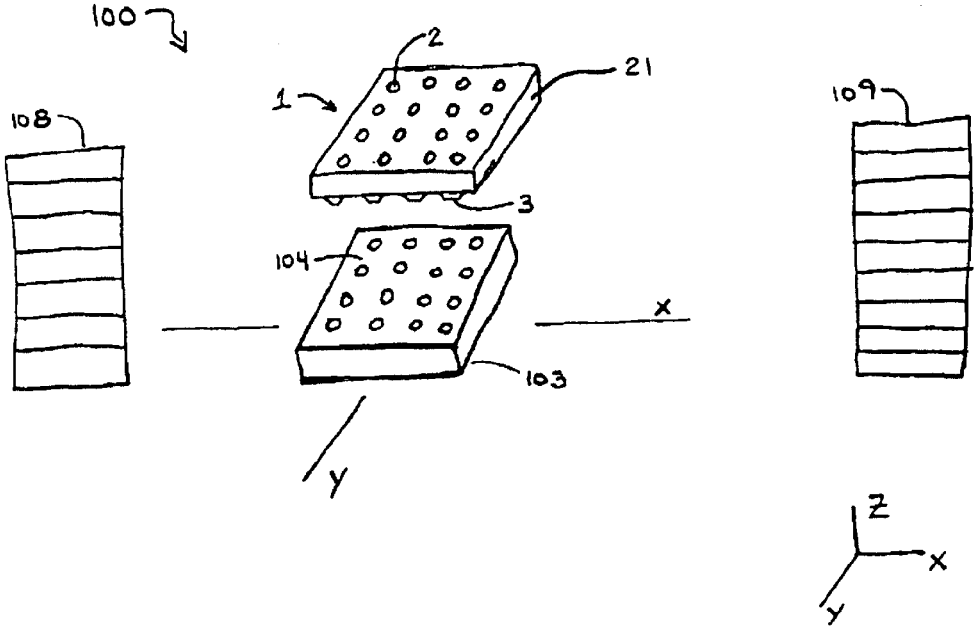
FIG. 12 is a schematic diagram of an exemplary self-dispensing plate in accordance with the present invention.

FIG. 12 shows the precision sample dispensing system of the present invention being used as part of an automated sample positioning system 100. As shown in FIG. 12, the automated sample positioning system 100 can include a positioning mechanism for the movement of one or more samples along a pathway between various destinations, or stations. The samples 6 can be contained within, for example a self-dispensing plate 21. Once at a destination or station 103, the samples 6 to be dispensed is first positioned with respect to the station 103. The automated sample positioning system 100 can receive samples from an input stack 108 and delivery the samples to an output stack 109 once the dispensing operation has been completed. Once at the station 103, the sample 6 may be dispensed or transferred to a destination device or another storage device 8 such as a reaction block or the like. The self-dispensing system 1 dispensing a precise and reproducible quantity of the sample 6 in more or more drops 7 until a measured quantity or volume of the sample 6 has been dispensed.

Figure 13:
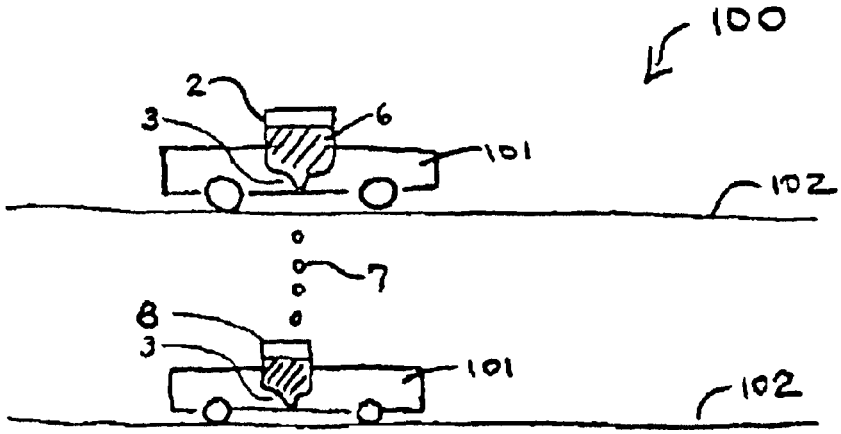
FIG. 13 is a side view of an exemplary robot carrying a single self-dispensing storage device of the present invention in an automated system.

FIG. 13 shows an exemplary automated system wherein the self-dispensing system 1 of the present invention is carried on one or more robots 101 that travel on tracks 102. The track system 102 is preferably multi-dimensional having multiple levels, such that one portion of the track may travel over another portion of the track. As shown, one robot 101 may travel over another robot 101 and dispensing a measured quantity or volume of the sample 6 to the storage device under it using the onboard self-dispensing system 1.

One suitable automated system 100 that the self-dispensing system 1 of the present invention can be used with is the "SYSTEM AND METHOD FOR SAMPLE POSITIONING IN A ROBOTIC SYSTEM", U.S. patent application Ser. No. 09/411,748, filed Oct. 1, 1999. This patent application describes an automated sample positioning system having robot to robot transfer and/or robot to workstation transfer, wherein the storage device or devices are included as part of the robot. This patent application is incorporated by reference in its entirety.

Figure 14:
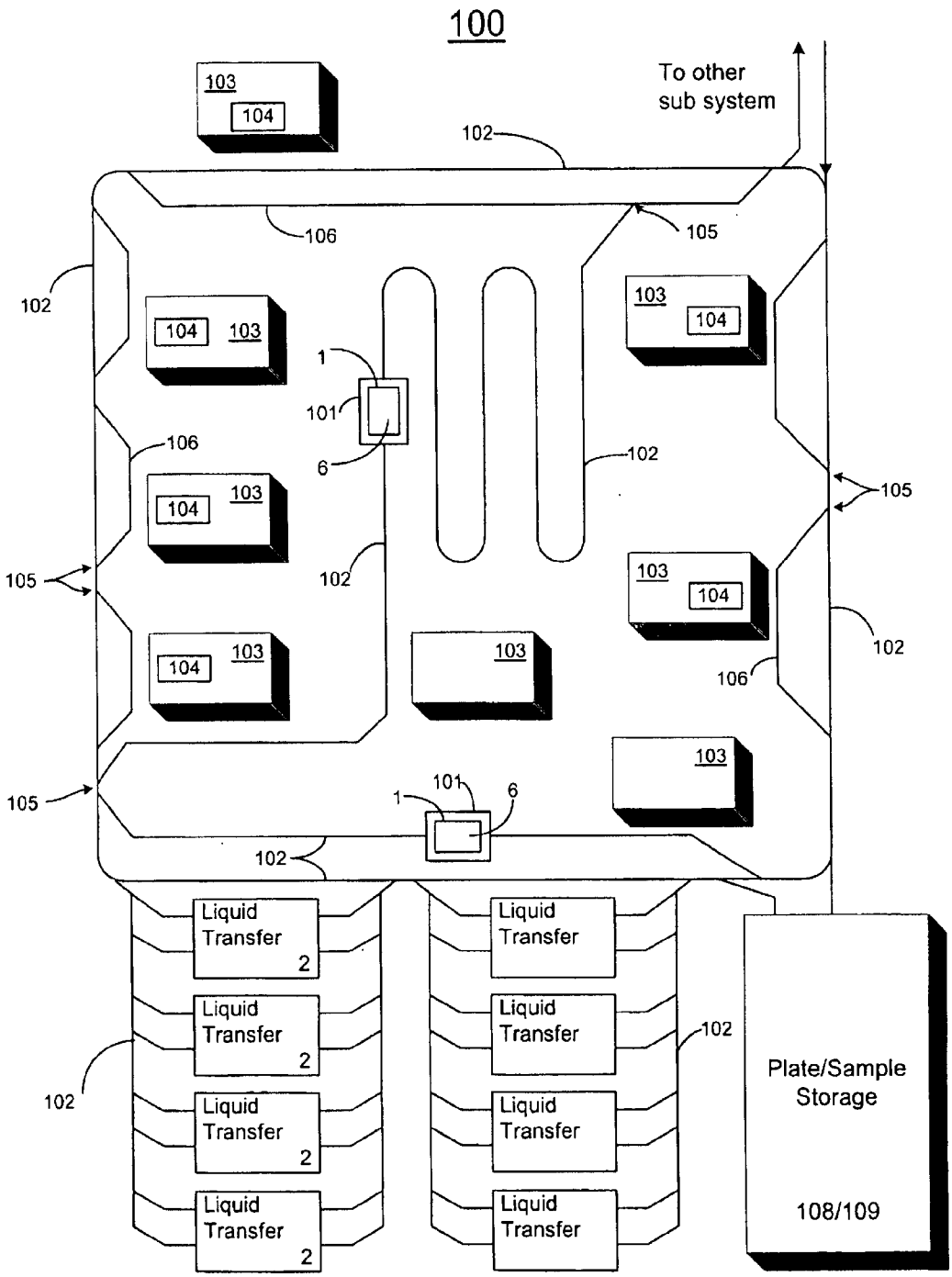
FIG. 14 is a schematic diagram of an exemplary layout of an automated sample positioning system that can be used with the self-dispensing system of the present invention.

FIG. 14 shows an exemplary automated system 100 in which the self-dispensing system 1 of the present invention may be used. As shown in FIG. 14, the automated system 100 includes a positioning system having one or more robots 101 that travel along a track system 102 that defines one or more predetermined pathways disposed between various stations 103. Each station has a device 104 or another storage device (e.g., a source 2 and/or destination 8 sample storage device) for interacting in some way with the self-dispensing system 1 that is carried on the robot 101. One or more intersections 105 are formed along the various pathways where the pathways diverge and converge, and where workstations are located. One or more siding 106 can be provided at each station 103 for allowing a robot 101 to exit a pathway onto the siding 106. The siding 106 for a station 103 allows other robot 101 traffic to pass while the self-dispensing system 1 on the robot 101 interact with a device 104 or another storage device 2 at the station 103. An indicator device (not shown) can be provided at each intersection 105 and at each station 103 which can be detected by a sensor device (not shown) on each robot, for determining when a robot 101 is at an intersection 105 or station 103. The sample transfer station could also be composed of two or more tracks arranged in a multi-level configuration wherein individual robots 101 may travel over or below a sample transfer station 103 or another sample storage device, such as shown in FIG. 13.

Figure 15:
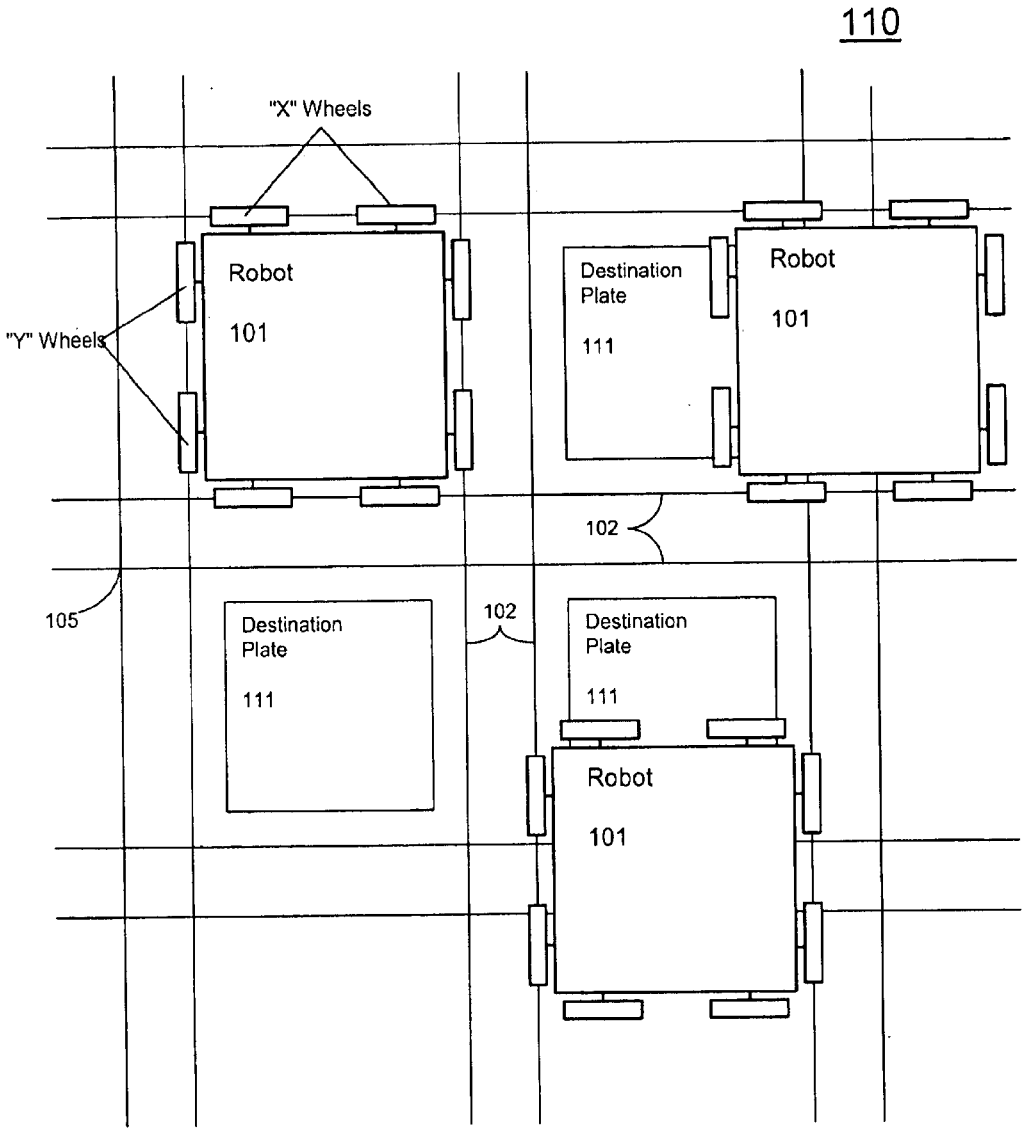
FIG. 15 is an exemplary grid type track system that can be used with the self-dispensing storage device of the present invention for movement of sample carrying robots between stations in an automated system.

FIG. 15 shows a grid-type, or array-type, track system 110 which is designed to create an arbitrarily large work surface on which robots 101 carrying self-dispensing plates 21 holding a sample 6 are set to be moved between workstations 103 or destination plates 111. Once at the destination plate 111 the self-dispensing system 1 on the robot 101 dispenses a measured quantity of a sample to the destination plate 111. The self-dispensing plates 21 are moved from one location 103 to another location 103 by robots 101 which can travel in X or Y directions along the grid system 110. Because these robots 101 have self-dispensing systems 1 onboard, the time required to perform the dispensing process is reduced and the through put of the automated system 100 can be improved. Also, no tip change or wash is required between each sample transfer.

FIG. 15 shows the basic layout of these robots 101 on the grid-type track system 10. Rails 102 are provided upon which the robots 101 run. As shown, each robot has a set of "X" wheels and a set of "Y" wheels. If the robot 101 is centered on a grid location and either changing direction or interacting with a plate, both sets of wheels are raised and the robot rests on, for example, indexing feet (not shown). If the robot 101 wants to move on the "X" direction, it lowers its "X" wheels and rolls in that direction. If it wants to change to travel in the "Y" direction, it raises the "X" wheels while at an intersection 105, then lowers the "Y" wheels. Note that this also realigns the robot ensuring that the new wheel set will properly engage.

In an automated system, the drive mechanism 4 is preferably controlled and operated using conventional techniques. For example, the control and operation function can be onboard (local) the robot 101 or can be located in a central controller (not shown) that communicates with each individual robot 101 to move the robots 101 around the automated system 100 and to also control the dispensing operation.

Two models for the control and operation of an automated system having self-dispensing storage device or plate include a first embodiment wherein the source and destination wells are placed in a workstation 103 that contains the drive mechanism 4. The drive mechanism 4 is then given the command to fire a predetermined number 'n' of drops from the source storage device 2 to the destination device 8. The workstation could have stackers, and the source and destination wells could be on 96 well plates, such as shown in FIG. 12. In this embodiment, the workstation 103 could stand alone, or be part of an automated system 100 with a separate mechanism to move samples. If in an automated system, the central controller (not shown) could send the commands to the workstation, otherwise the operator would do it through, for example, a front control panel (not shown).

Alternatively, the wells 2 can be on robots 101 that travel on tracks 102 so that the source storage device 2 is positioned over the destination device 8. The two robots can communicate with each other or a third computer (e.g., a central controller) that can coordinates their activities. When all is in alignment, the top robot fires the actuator pump 'n' times to dispense the desired volume.

Also, in an automated system, the dispensing operation can be powered using a mechanical, electrical, electromagnetic, or air driven power source. The power source would depend on several factors, including whether the drive mechanism is internal or external, etc.

FIG. 16 shows an exemplary robot 101 having a self-dispensing system 1 in accordance with the present invention. As shown in FIG. 16, the robot 101 includes a body 115, a self-dispensing plate 21, a propulsion mechanism 116, and track engagement mechanism 117. Alternatively, the robot 101 could include a single self-dispensing storage device 20. Preferably, each robot 101 also includes a controller 118, a drive system 119, and a power supply 120. The robot 101 can include various displays (not shown) and/or indicators (not shown) for showing a state of the robot 101. In addition, the robot 101 can include an identification system, a collision avoidance system, and an error correction system (not shown).

As shown, the self-dispensing plate 21 can be located on top of the robot 101 and can include, for example, any standard microtiter plate format, such as a 4-well plate, a 24-well plate, a 96-well plate, a 384-well plate, a 1536-well plate, a 9600-well plate, etc. The wells 119 may be varying depths, such as shallow or deep well. The wells 119 may have a variety of shapes based on the application and the samples that they will carry and the wells can have a flat, a U-shaped, or a V-shaped bottom. Preferably, the self-dispensing well plates 21 meet SBS standards, are made from optically quality polystyrene to allow direct sample observation, and have raised rims (not shown) to prevent cross-contamination. Alternatively, robot 101 can include a single self-dispensing storage device 20, as shown in FIG. 13, or any other size or type of container or platform depending on the particular application, such as standard or non-standard sizes of, for example, a vial, a test tube, a pallet, a cup, a beaker, a matrices, etc.

This robotic sample positioning system 100 having robots 101 with self-dispensing systems 1 is conceived to be implemented in multiple scales. For example, in a first embodiment of the invention, the scale can be designed to work with standard size microtiter plates. These standard plates are approximately 125 mm by 85 mm. The wells of a 96-well plate are on about 9 mm centers and hold from about 30 $\mu$l to about 1500 $\mu$l depending on the plate depth. In another embodiment of the invention, the scale could be significantly smaller. For example, a 96-well plate could be approximately 16 mm by 12 mm, with wells on about 1 mm centers. These wells would hold approximately 1 $\mu$l. The sample 6 contained within the well would be transferred by the onboard dispensing mechanism 3, such as describe herein above.

Figure 17:
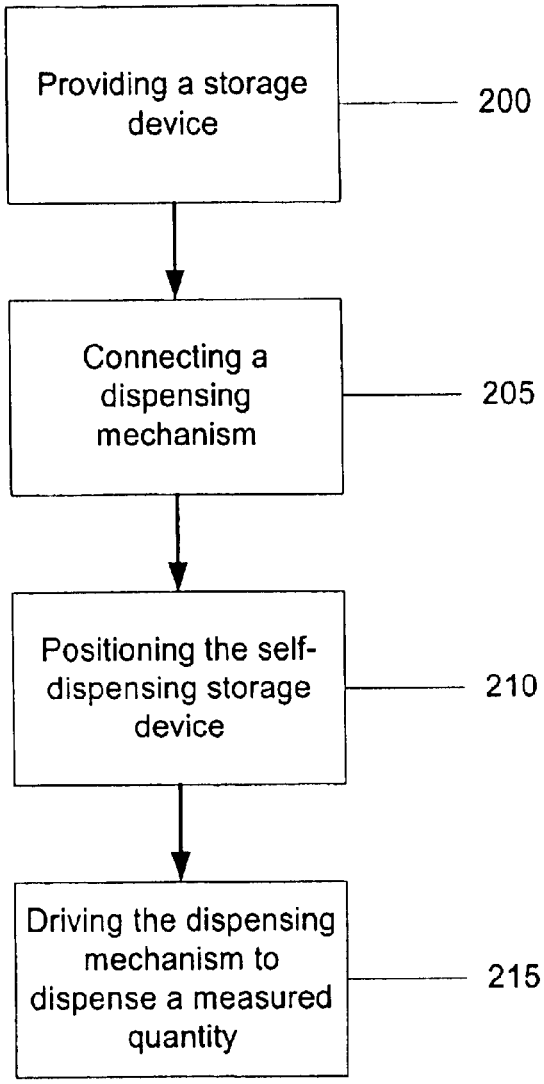
FIG. 17 is a flowchart of an exemplary method of precisely and reproducibly dispensing a sample using a self-dispensing storage device or plate in accordance with the present invention.

FIG. 17 shows an exemplary method for precisely dispensing a sample using a self-dispensing storage device or a self-dispensing plate. As shown in FIG. 17, the method includes providing one or more storage devices each having one or more reservoirs for holding a sample, at step 200. Connecting a dispensing mechanism capable of precisely and reproducibly dispensing a measured volume of a sample in dispensing communication with each of the one or more reservoir, at step 205. The dispensing mechanism and the storage device form a self-dispensing storage device. Positioning the self-dispensing storage device in dispensing relationship with a destination device or another self-dispensing storage device capable of receiving the measured volume of the dispensed sample, at step 210. Driving the dispensing mechanism using a driving mechanism to dispense measured quantity or volume of sample, at step 215. The self-dispensing method dispenses the sample in one or more measured drops until the measured quantity has been dispensed by the dispensing mechanism. The measured drops are precisely measured and reproducible in volume.

The present invention comprising a system and method for accurately and precisely dispensing a sample to be worked on or manipulated using a dispensing mechanism 3 that is formed integral with and in dispensing communication with a sample storage device 2 (e.g., connected to the storage device), preferably in an automated or robotic system, and has significant value in those situations where there are compelling needs for no tip washes or changes, less daughter plates are required, minimal cross contamination, and the like.

Although illustrated and described herein with reference to certain specific embodiments, it will be understood by those skilled in the art that the invention is not limited to the embodiments specifically disclosed herein. Those skilled in the art also will appreciate that many other variations of the specific embodiments described herein are intended to be within the scope of the invention as defined by the following claims.

What is claimed is:

1. A self-dispensing system for dispensing a measured quantity or volume of a sample comprising:

one or more disposable storage devices for holding a sample to be dispensed;

a dispensing mechanism connected to each of said one or more storage devices, said dispensing mechanism being in dispensing communication with said storage device for precisely dispensing a measured quantity of said sample from said storage device; and a driving mechanism that drives said dispensing mechanism thereby dispensing said sample, wherein said driving mechanism is positioned external to the dispensing mechanism and does not come into contact with said sample.

2. The self-dispensing system of claim 1, wherein said one or more disposable storage devices comprises a multi-well plate, wherein each of said wells of said multi-well plate has a corresponding dispensing mechanism.

3. The self-dispensing system of claim 2, wherein said multi-well plate further comprises a standard microtiter plate having a plurality of wells on evenly spaced centers.

4. The self-dispensing system of claim 3, wherein said standard microtiter plate further comprises one or more of a 4-well plate, a 24-well plate, a 96-well plate, a 384-well plate, a 1536 well plate, and a 9600-well plate.

5. The self-dispensing system of claim 4, wherein said standard microtiter plate further comprises one or more of a 96-well plate with wells on about 9 mm centers having a capacity of about 30 microliters to about 1500 microliters and a 96-well plate with wells on about 1 mm centers having a capacity of about 1 microliters.

6. The self-dispensing system of claim 1, wherein said storage device comprises:

a reservoir for holding said sample; and at least one opening in said reservoir for communicating a sample between said reservoir and said dispensing mechanism.

7. The self-dispensing system of claim 6, wherein said storage device comprises a collapsible reservoir.

8. The self-dispensing system of claim 6, wherein said storage device comprises a semi-rigid reservoir having a dispensed volume replacement mechanism for replacing a volume equal to a volume of said measured quantity of said dispensed sample.

9. The self-dispensing system of claim 1, wherein said dispensing mechanism comprises a positive displacement pump-type dispensing mechanism capable of precisely and reproducibly dispensing a measured quantity of said sample.

10. The self-dispensing system of claim 1, wherein said dispensing mechanism dispenses a reproducible measured volume for each of said dispensed measured quantity of said sample to an accuracy of about 5 microliters.

11. The self dispensing system of claim 1, wherein said dispensing mechanism dispenses a reproducible measured volume for each of said dispensed measured quantity of said sample to an accuracy of about 1 microliters.

12. The self-dispensing system of claim 1, wherein said dispensing mechanism dispenses a reproducible measured volume for each of said dispensed measured quantity of said sample to an accuracy of about 0.5 microliters.

13. The self-dispensing system of claim 1, wherein said dispensing mechanism dispenses a reproducible measured volume for each of said dispensed measured quantity of said sample to an accuracy of about 0.1 microliters.

14. The self-dispensing system of claim 9, wherein said positive displacement pump-type dispensing mechanism further comprises:

an inlet valve having an inlet opening for receiving said sample to be dispensed from said storage device;

an actuator fluidly connected to said inlet valve for dispensing said sample; and an outlet valve fluidly connected to said actuator for receiving and controlling a flow of said dispensed sample from said actuator.

15. The self-dispensing system of claim 9, wherein said positive-displacement pump-type dispensing mechanism further comprises:

an inlet valve selectively moveable between an open position wherein said inlet valve allows a flow of said sample from said storage device to said actuator and a closed position wherein said inlet valve prevents a flow of said sample from said actuator back into said storage device;

an actuator having a suction stroke that draws a sample from said reservoir as said actuator moves in a first direction, and a discharge stroke that pushes said sample out as said actuator move in a second direction; and an outlet valve which is selectively movable between an open position wherein said outlet valve allows said sample to be dispensed on said discharge stoke and a closed position wherein said outlet valve prevents air from entering said actuator.

16. The self dispensing ing system of claim 9, wherein said dispensing mechanism comprises a cow udder type of dispensing mechanism.

17. The self-dispensing system of claim 1, further comprising a filter disposed between said storage device and said dispensing system.

18. The self-dispensing system of claim 1, wherein said self-dispensing storage device, with its sample, are freezable to at least about −20° C., and is capable of being thawed and dispensed.

19. The self-dispensing system of claim 1, wherein at least said storage device and said dispensing mechanism are disposable after said sample has been completely dispensed.

20. The self-dispensing system of claim 1, wherein said driving mechanism activates one or more of said dispensing mechanisms corresponding to said one or more storage device at a time.

21. The self-dispensing system of claim 1, further comprising an automated system having one or more robots for positioning said self-dispensing storage device with respect to a workstation or another storage device and a controller for initiating a dispensing operation of said sample by said self-dispensing storage device.

22. A self-dispensing system comprising:

a first self-dispensing storage device comprising:

a storage device having one or more reservoirs for holding a sample to be dispensed;

one or more corresponding dispensing mechanisms connected to and in dispensing communication with each of said one or more reservoirs of said storage device;

a second self-dispensing storage device comprising:

a storage device having one or more reservoirs for holding a sample to be dispensed;

one or more corresponding dispensing mechanisms connected to and in dispensing communication with each of said one or more reservoirs of said storage device;

a driving mechanism for driving said dispensing mechanism of said first self-dispensing storage device, wherein said driving mechanism is positioned external to the dispensing mechanism and does not come into contact with said sample; and wherein a precise and reproducible measured volume of said sample is dispensed from said one or more reservoirs of said first self-dispensing storage device to said one or more reservoirs of said second self-dispensing storage device.

23. The self-dispersing system of claim 22, further comprising a robotic system having one or more robots for positioning said first self-dispensing storage device in relation to said second self-dispensing storage device.

24. The self-dispensing system of claim 23, wherein said first self-dispensing storage device is positioned over said second self-dispensing storage device.

25. The self-dispensing system of claim 23, wherein said one or more robots have positioning and transferring features for locating said robots and said self-dispensing storage devices with respect to one another and for dispensing said measured volume of said sample.

* * * * *

UNITED STATES PATENT AND TRADEMARK OFFICE

CERTIFICATE OF CORRECTION

PATENT NO. : 6,911,181 B1
DATED : June 28, 2005
INVENTOR(S) : John McNeil

It is certified that error appears in the above-identified patent and that said Letters Patent is hereby corrected as shown below:

Column 18,
Line 65, delete “stoke” and insert -- stroke --;

Column 19,
Line 1, insert -- - -- between “self” and “dispensing”;
Line 1, delete “ing”.

Signed and Sealed this

Sixth Day of June, 2006

JON W. DUDAS
*Director of the United States Patent and Trademark Office*